US009971269B2

(12) United States Patent
Ohi et al.

(10) Patent No.: US 9,971,269 B2
(45) Date of Patent: May 15, 2018

(54) DISCHARGING METHOD FOR LATENT IMAGE BEARER AND IMAGE FORMING APPARATUS

(71) Applicants: Ryouhei Ohi, Kanagawa (JP); Takafumi Miyazaki, Osaka (JP); Yuuji Meguro, Kanagawa (JP); Yasuhiro Fujiwara, Kanagawa (JP)

(72) Inventors: Ryouhei Ohi, Kanagawa (JP); Takafumi Miyazaki, Osaka (JP); Yuuji Meguro, Kanagawa (JP); Yasuhiro Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/590,129

(22) Filed: May 9, 2017

(65) Prior Publication Data

US 2017/0336729 A1 Nov. 23, 2017

(30) Foreign Application Priority Data

May 23, 2016 (JP) ..... 2016-102775
Apr. 25, 2017 (JP) ..... 2017-086110

(51) Int. Cl.
*G03G 13/045* (2006.01)
*G03G 15/06* (2006.01)
(Continued)

(52) U.S. Cl.
CPC ..... *G03G 13/045* (2013.01); *G03G 15/0208* (2013.01); *G03G 15/0291* (2013.01); *G03G 15/06* (2013.01); *G03G 15/24* (2013.01); *G03G 15/65* (2013.01); *G03G 2215/02* (2013.01); *G03G 2221/00* (2013.01)

(58) Field of Classification Search
CPC ..... G03G 13/045
See application file for complete search history.

(56) References Cited

U.S. PATENT DOCUMENTS 4,173,406 A * 11/1979 Oyama ..... G03G 15/047 355/1
2011/0020034 A1* 1/2011 Tsutsumi ..... G03G 21/08 399/128

(Continued)

FOREIGN PATENT DOCUMENTS

JP 4-093961 3/1992
JP 7-261614 10/1995

(Continued)

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

A discharging method used in an image forming apparatus includes discharging, with an exposure device, an exposure range of the latent image bearer, and discharging, with a discharger, an area of the latent image bearer outside the exposure range and inside a developing range in a main scanning direction. The exposure range is inside the developing range in the main scanning direction. The discharging with the exposure device and the discharging with the discharger are performed when a rotation of the latent image bearer is stopped after a toner image is transferred from the latent image bearer.

11 Claims, 15 Drawing Sheets

(51) Int. Cl.

| | |
|---|---|
| ***G03G 15/00*** | (2006.01) |
| ***G03G 15/02*** | (2006.01) |
| ***G03G 15/24*** | (2006.01) |

(56) References Cited

U.S. PATENT DOCUMENTS

| | | | |
|---|---|---|---|
| 2013/0266332 | A1 | 10/2013 | Miyazaki et al. |
| 2015/0003852 | A1 | 1/2015 | Yamashita et al. |

FOREIGN PATENT DOCUMENTS

| | | |
|---|---|---|
| JP | 8-234646 | 9/1996 |
| JP | 2002-296990 | 10/2002 |
| JP | 2015-215548 | 12/2015 |

* cited by examiner

DISCHARGING METHOD FOR LATENT IMAGE BEARER AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2016-102775 filed, on May 23, 2016, and 2017-086110 filed, on Apr. 25, 2017, in the Japan Patent Office, the entire disclosure of each of which is hereby incorporated by reference herein.

BACKGROUND

Technical Field

Embodiments of this disclosure generally relate to a method of discharging a latent image bearer and an image forming apparatus, such as a copier, a printer, a facsimile machine, or a multifunction peripheral having at least two of copying, printing, facsimile transmission, plotting, and scanning capabilities, that employs the method of discharging.

Description of the Related Art

There are image forming apparatuses that include a latent image bearer, a charger to discharge the latent image bearer uniformly, an exposure device to expose the latent image bearer to form an electrostatic latent image, developing device to supply developer to the electrostatic latent image, thereby developing the electrostatic latent image into a toner image, and a transfer device to transfer the toner image onto a transfer medium. In such image forming apparatuses, it is known that, after the transfer device transfers the toner image therefrom, the surface of the latent image bearer is discharged when rotation of the latent image bearer is stopped.

SUMMARY

An embodiment of the present invention provides a discharging method used in an image forming apparatus including a latent image bearer, an exposure device to expose the latent image bearer to form an electrostatic latent image on the latent image bearer, and a discharger different from the exposure device.

The discharging method includes discharging, with the exposure device, an exposure range of the latent image bearer, the exposure range inside a developing range in a main scanning direction; and discharging, with the discharger, an area of the latent image bearer outside the exposure range and inside the developing range in the main scanning direction.

The discharging with the exposure device and the discharging with the discharger are performed when a rotation of the latent image bearer is stopped after a toner image is transferred from the latent image bearer.

In another embodiment, an image forming apparatus includes a latent image bearer; a charger to charge a surface of the image bearer uniformly; an exposure device to expose an exposure range of the latent image bearer to form an electrostatic latent image on the latent image bearer; a developing device to develop, in a developing range, the electrostatic latent image with developer into a toner image, the developing range wider than the exposure range in a main scanning direction; a transfer device to transfer the toner image from the image bearer onto a transfer medium; and a discharger different from the exposure device, to discharge the latent image bearer. The exposure device and the discharger discharge the latent image bearer when the rotation of the latent image bearer is stopped after the transfer device transfers the toner image. The exposure device discharges the exposure range inside the developing range in the main scanning direction. The discharger discharges an area of the latent image bearer outside the exposure range and inside the developing range in the main scanning direction.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
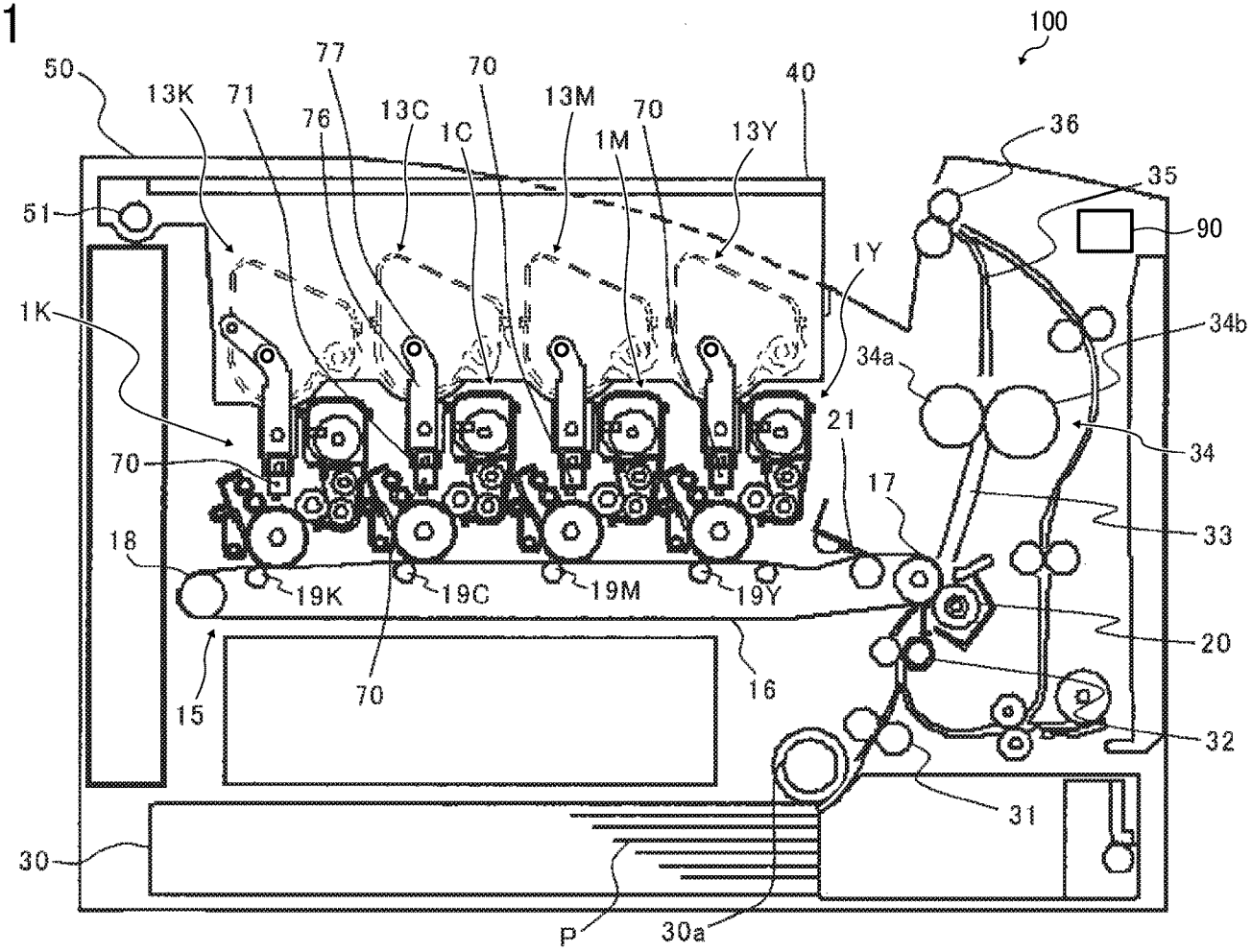
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Described below is an image forming apparatus 100 capable of forming images on A3-size sheets, a method of discharging a latent image bearer, according to an embodiment, with reference to FIGS. 1 and 2. For example, the image forming apparatus 100 is a color printer.

FIG. 1 is a schematic view of the image forming apparatus 100 according to the present embodiment. FIG. 2 is an enlarged view of a process unit 1 for black, incorporated in the image forming apparatus 100.

Figure 2:
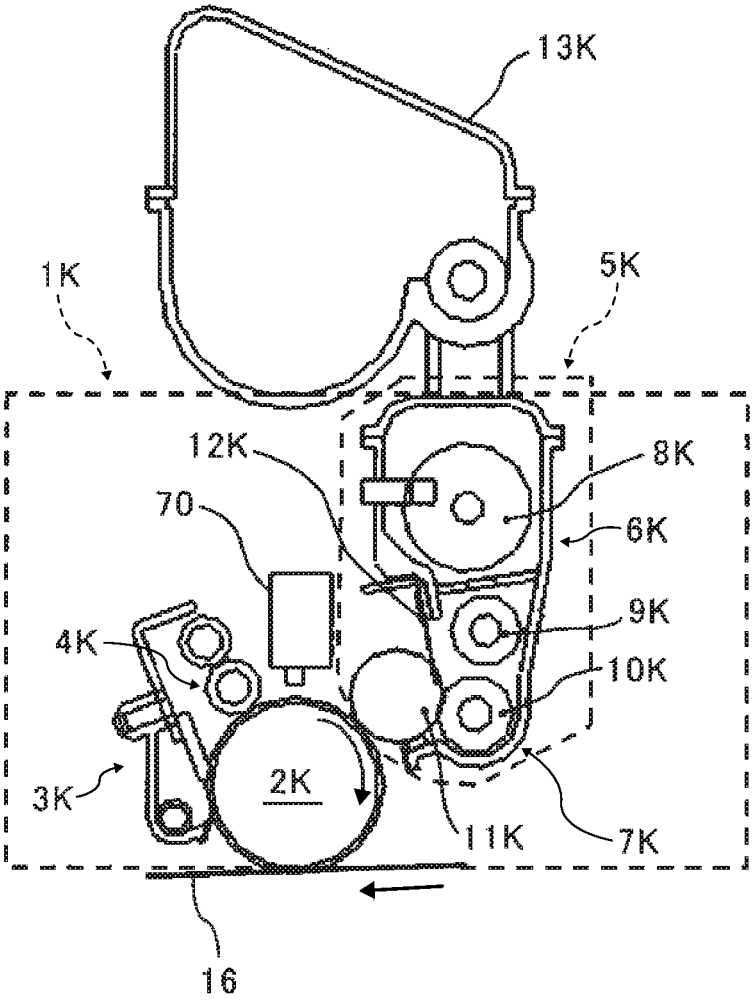
FIG. 2 is an enlarged cross-sectional view of a process unit for black, incorporated in the image forming apparatus illustrated in FIG. 1.

The schematic view illustrated in FIG. 1 and the enlarged view illustrated in FIG. 2 are cross-sectional views as viewed from a side of the image forming apparatus 100. A front side (e.g., on which an operation panel is disposed) of the image forming apparatus 100 is on the right in the drawings, and a rear side thereof is on the left in the drawings.

The image forming apparatus 100 illustrated in FIG. 1 is a color printer employing a tandem system and intermediate transferring and includes four process units 1Y, 1M, 1C, and 1K for forming yellow (Y), magenta (M), cyan (C), and black (K) toner images.

The four process unit 1 (Y, M, C, and K) are similar in configuration, differing only in the color of toner employed for image formation. The process units 1 are replaced when the operational lives thereof expire. The image forming apparatus 100 includes a controller 90 to perform various types of control processing by executing programs stored in a memory. The controller 90 can be a computer including a central processing unit (CPU) and associated memory units such as a read only memory (ROM), a random access memory (RAM), etc.

Although FIGS. 1 and 2 illustrates a configuration of the image forming apparatus 100 employing contact-type one-component development, one or more aspects according to this disclosure are applicable to contactless development and two-component development.

Next, descriptions are given below of the image forming process performed by the image forming apparatus 100, using the process unit 1K for forming black toner images, as an example.

As illustrated in FIG. 2, the photoconductor 2 serving as a latent image bearer is drum-shaped and includes a conductive support base, a photoconductive layer, and an insulation layer.

Initially, a charging roller 4K (i.e., a charging device) charges the photoconductor 2 to have a uniform surface potential. Subsequently, in response to image data, a light emitting diode (LED) head 70 irradiates the photoconductor 2 with light according to the image data. The exposed surface of the photoconductor 2 is optically attenuated, and an electrostatic latent image corresponding to an image signal is formed.

By contrast, a constant bias voltage is applied to a developing roller 11K, serving as a developer bearer, disposed in a developing portion 7K of a developing device 5K. As the photoconductor 2K bearing the electrostatic latent image contacts the developing roller 11K, an electrical potential difference is caused between the photoconductor 2K and the developing roller 11K. The electrical potential difference causes the toner magnetically adhering to the developing roller 11K to adhere to the exposed portion of the surface of the photoconductor 2. Thus, the electrostatic latent image on the photoconductor 2 is visualized. Then, the toner image is transferred from the photoconductor 2K onto an intermediate transfer belt 16 (a transfer medium).

A cleaning blade of a photoconductor cleaning device 3 removes residual toner remaining on the photoconductor 2 after the image is transferred from the photoconductor 2. Then, the LED head 70 removes the electric charge from the photoconductor 2, and the photoconductor 2 is prepared for the subsequent image forming operation.

Similar to the process unit 1K, the process units 1Y, 1M, and 1C form yellow, magenta, and cyan toner images on the photoconductors 2Y, 2M, and 2C, respectively, and the yellow, magenta, and cyan toner images are transferred onto the intermediate transfer belt 16 and further transferred onto a recording sheet P serving as a recording medium.

As illustrated in FIG. 2, the developing device 5K includes a hopper 6K to contain black toner and the developing portion 7K. The hopper 6K is long in a vertical direction.

The toner is supplied from a toner cartridge 13K to the hopper 6K according to the amount of toner consumed in printing, so that the hopper 6K contains a constant image of toner.

The hopper 6K includes an upper conveying screw 8K rotated by a driver and a lower conveying screw 9K disposed below the upper conveying screw 8K, driven by the driver, and a toner supply roller 10K disposed below the lower conveying screw 9K, driven by the driver.

The toner in the hopper 6K moves down under the gravity toward the toner supply roller 10K, while being stirred by the upper conveying screw 8K and the lower conveying screw 9K.

The toner supply roller 10K includes a metal core bar and a roller body overlying the metal core bar. The roller body is made of foamed resin, for example. The toner supply roller 10K rotates while attracting the black toner in the developing device 5K to the surface of the roller body.

The developing portion 7K of the developing device 5K includes the developing roller 11K and a leveling blade 12K. The developing roller 11K rotates while contacting the photoconductor 2K and the toner supply roller 10K. An end (or edge) of the leveling blade 12K is disposed abutting against the developing roller 11K.

The toner supply roller 10K inside the hopper 6K and the developing roller 11K are charged negatively. At a contact part between the developing roller 11K and the toner supply roller 10K, the black toner adhering to the toner supply roller 10K is supplied to the developing roller 11K, while negative charge is applied to the black toner.

As the developing roller 11K rotates, the toner supplied to the surface of the developing roller 11K passes through the contact position between the developing roller 11K and the leveling blade 12K, where the thickness of the layer of developer on the developing roller 11K is regulated.

Similar operations are performed in the developing devices 5 (Y, M, and C).

In FIGS. 1 and 2, the LED head 70 is disposed above the photoconductor 2.

One LED head 70 is provided for each of the process units 1. According to the image data, a light-emitting element (e.g., an LED) disposed at a predetermined position emits light. Accordingly, the photoconductors 2 (Y, M, C, and K) in the process units 1 (Y, M, C, and K) are exposed, and electrostatic latent images for yellow, magenta, cyan, and black are formed on the photoconductors 2 (Y, M, C, and K), respectively.

The LED head 70 includes a plurality of light-emitting elements (e.g., LEDs) lined in the longitudinal direction of the photoconductor 2. The LED head 70 irradiates the photoconductor 2 with the light emitted from the light-emitting elements, through lenses lined in the longitudinal direction of the photoconductor 2, to form an electrostatic latent image.

Since the LED head 70 emits the light for imaging of the electrostatic latent image, light-emitting elements having a high resolution and a high directivity are used. The light-emitting element is not limited to LEDs but can be any element, such as an organic electro-luminescent (EL) element, having a similar resolution and a similar directivity.

After the layer thickness thereof is regulated, the lack toner on the developing roller 11K reaches a developing range (i.e., a developing position), which is a contact part between the developing roller 11K and the photoconductor 2K. Then, the black toner adheres to the electrostatic latent image for black on the surface of the photoconductor 2K.

As the toner adheres thereto, the electrostatic latent image for black is developed into a black toner image.

The process unit 1K for black is described above with reference to FIG. 2. The other process units 1 (Y, M, and C) form yellow, magenta, and cyan toner images through similar processes on the surfaces of the photoconductors 2 (Y, M, and C), respectively.

Below the process units 1 (Y, M, C, and K), a transfer unit 15 is disposed. The transfer unit 15 includes the intermediate transfer belt 16, which is stretched around multiple rollers and is rotated counterclockwise, endlessly, in FIG. 1.

In addition to the intermediate transfer belt 16, the transfer unit 15, which is a driver, includes a driving roller 17, a driven roller 18, four primary transfer rollers 19 (Y, M, C, and K), and a belt cleaner 21.

The intermediate transfer belt 16 is stretched around the driving roller 17, the driven roller 18, and the four primary transfer rollers 19, which are disposed on the inner side of the loop of the intermediate transfer belt 16.

As the driving roller 17 is rotated counterclockwise by a driver, the intermediate transfer belt 16 rotates in the same direction.

The four primary transfer rollers 19 (Y, M, C, and K) press the intermediate transfer belt 16, which moves endlessly, against the photoconductors 2 (Y, M, C, and K), respectively, and thus the intermediate transfer belt 16 is nipped therebetween.

Figure 6A:
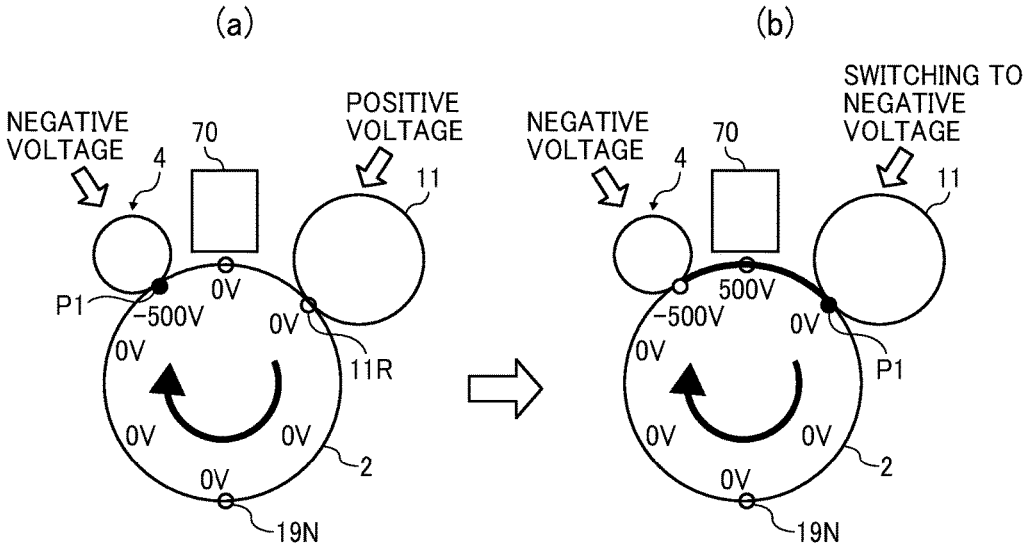
FIG. 6A is a schematic cross-sectional view of the photoconductor, with surface potential thereof, in a case where adjustment and printing are performed after a relatively long unused time.
Figure 6B:
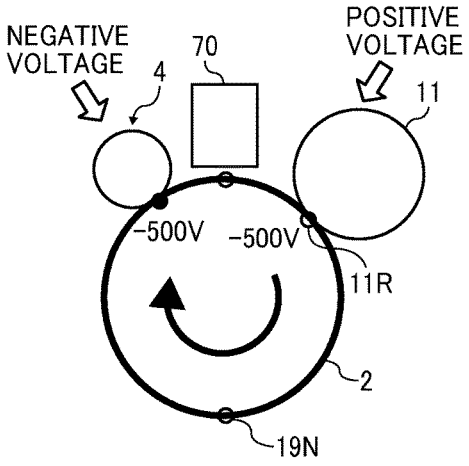
FIG. 6B is a schematic cross-sectional view of the photoconductor, with surface potential thereof, in a case where the photoconductor is not discharged after a previous printing operation.

The areas where the outer surface of the intermediate transfer belt 16 contacts the photoconductors 2 (Y, M, C, K) are called primary transfer nips 19N (illustrated in FIGS. 6A and 6B).

A transfer bias power supply applies a positive primary transfer bias to each of the primary transfer rollers 19 (Y, M, C, and K), and thus transfer electric fields are generated between the electrostatic latent images on the photoconductors 2 (Y, M, C, and K) and the primary transfer rollers 19 (Y, M, C, and K), respectively.

Instead of the primary transfer rollers 19 (Y, M, C, and K), any transfer member, such as a transfer charge or a transfer brush, capable of generating a transfer electrical field is usable.

In the process unit 1Y for yellow, as the photoconductor 2Y rotates, driven by a photoconductor motor, the yellow toner image on the surface of the photoconductor 2Y enters the primary transfer nip for yellow. Then, the yellow toner image is primarily transferred from the photoconductor 2Y onto the intermediate transfer belt 16 due to effects of the transfer electric field and nip pressure. After the yellow toner image is transferred therefrom, the intermediate transfer belt 16 passes through the primary transfer nip for magenta, cyan, and black while rotating. Then, the magenta, cyan, and black toner images on the photoconductors 2 (M, C, and K) are sequentially transferred primarily and superimposed on the yellow toner image.

With the superimposition, a four-color composite toner image is formed on the intermediate transfer belt 16.

The secondary transfer roller 20 of the transfer unit 15 is positioned outside the loop of the intermediate transfer belt 16. The secondary transfer roller 20 nips the intermediate transfer belt 16, together with the driven roller 18 disposed inside the loop.

With this nipping, the portion where the outer surface of the intermediate transfer belt 16 contacts the secondary transfer roller 20 serves as a secondary transfer nip.

The transfer bias power supply applies a positive secondary transfer bias to the secondary transfer roller 20.

With the application of bias, a secondary transfer electric field is formed between the secondary transfer roller 20 and the driven roller 18, which is grounded.

A sheet tray 30 containing a plurality of recording sheets P is disposed below the transfer unit 15. The sheet tray 30 is to slide to be retracted into the housing of the image forming apparatus 100 and removed therefrom.

The sheet tray 30 is provided with a sheet feed roller 30*a* disposed to contact the recording sheet on the top of a bundle of recording sheets P. The sheet feed roller 30*a* rotates counterclockwise in the drawing, at a predetermined timing to send out the recording sheet P toward a sheet conveyance path 31.

At an end of the sheet conveyance path 31, a registration roller pair 32 is disposed. The registration roller pair 32 stops rotating immediately after the recording sheet P fed from the sheet tray 30 is sandwiched therebetween. The registration roller pair 32 then resumes rotation to forward the recording sheet P to a secondary transfer nip, timed to coincide with the four-color toner image on the intermediate transfer belt 16.

In the secondary transfer nip, with effects of the secondary transfer electrical field and the nip pressure, the four-color toner image is transferred secondarily from the intermediate transfer belt 16 onto the recording sheet P at a time and becomes a full-color toner image (hereinafter "multicolor toner image") on the white recording sheet P.

The recording sheet P carrying the full-color toner image is separated from the secondary transfer roller 20 and the intermediate transfer belt 16 due to the curvature after the recording sheet P passes through the secondary transfer nip. After the transferring, the recording sheet P is sent into a fixing device 34, which will be described later, via a post-transfer conveyance path 33.

On the intermediate transfer belt 16 that has passed the secondary transfer nip, residual toner, not untransferred onto the recording sheet P, remains.

The belt cleaner 21, which is in contact with the outer surface of the intermediate transfer belt 16, removes the residual toner from the surface of the intermediate transfer belt 16.

The fixing device 34 includes a fixing roller 34*a* and a pressure roller 34*b*. The fixing roller 34*a* contains a heat source such as a halogen lamp. The pressure roller 34*b* rotates while pressing against the fixing roller 34*a*, thereby forming a fixing nip therebetween.

In the fixing device 34, the recording sheet P is nipped in the fixing nip such that a surface bearing an unfixed toner image tightly contacts the fixing roller 34*a*. With heat and pressure, the toner is melted, and the full-color toner image is fixed on the recording sheet P.

The recording sheet P ejected from the fixing device 34 is conveyed through a post-fixing conveyance path 35 and ejected by an ejection roller pair 36 outside the apparatus and stacked on a sheet stack section, which is an upper face of an upper cover 50 of the apparatus housing.

The LED head 70 is disposed adjacent to the photoconductor 2 and obstructs replacement of the process unit 1, which is a consumable. Therefore, the LED head 70 is moved away from the photoconductor 2 when the process unit 1 is replaced.

The upper cover 50 and a middle cover 40 are supported by the apparatus housing, to pivot around a rotation shaft 51. The upper cover 50 and a middle cover 40 are opened for replacement of consumables.

The LED head 70 is held by a head holder 71 (in FIG. 1) and pressed toward the photoconductor 2 by a spring. The head holder 71 is held by a connector 76. An end of the connector 76 is rotatably held by the middle cover 40 via a rotator 77.

Since the connector 76 is held by the middle cover 40, the LED head 70 is disposed brought into contact and moved away from the photoconductor 2 in conjunction with opening and closing of the middle cover 40.

In the above-described developing system, after the photoconductor 2 is left unused for a while, the surface potential of the photoconductor 2 is close to zero volt at the activation of the developing device 5. Accordingly, at the activation of the image forming apparatus 100, a positive voltage is applied to the developing roller 11 so that the negatively charged toner is not used in image development.

In a case where the photoconductor 2 has a negative potential when the apparatus enters standby or sleep mode, the potential difference between the developing roller 11 and the photoconductor 2 is large if a positive voltage is applied to the developing roller 11 at the subsequent activation of the apparatus. Then, undesirable toner, such as toner charged to the opposite polarity and toner charged insufficiently, adheres to the surface of the photoconductor 2.

Accordingly, the toner adheres to a background area, which is a portion supposed to be free of toner, and this phenomenon is called background fog (or background fouling). If the amount of toner adhering to the background area is large, toner falling or toner scattering inside the apparatus may occur.

Although the description above concerns the developing system employing contact-type, one-component development, background fouling caused by adhesion of undesirable toner can occur also in contactless development. In two-component development, scattering of carrier arises in addition to the above-described inconvenience.

To suppress the above-described inconvenience, in the image forming apparatus 100 according to the present embodiment, at the end of operation (e.g., to enter a standby or sleeve mode or at the shut down), to make the surface potential of the photoconductor 2 close to zero (0) volt, the LED head 70 discharges, by exposure, the surface of the photoconductor 2 in the width of the developing roller 11.

However, structures necessary for the developing system are disposed dense in the end portions of the developing range of the photoconductor 2 in the longitudinal direction of the photoconductor 2. Such structures include a holder of the photoconductor 2, a holder of the developing roller 11, spacers between the photoconductor 2 and the LED head 70. Accordingly, the LED head 70 is not extended to the end portions of the developing range of the photoconductor 2 in the longitudinal direction thereof, and it is difficult to fully discharge the developing range of the photoconductor 2 in the longitudinal direction.

To extend the LED head 70 to the end of the photoconductor 2 in the longitudinal direction of the photoconductor 2, it is necessary that the above-mentioned holders and the like are disposed outside the developing range (i.e., further from the center side than the developing range) in the longitudinal direction. Accordingly, the process unit 1, to which the holders and the like are attached, is extended long in the longitudinal direction of the photoconductor 2, and the image forming apparatus 100 incorporating the process unit 1 become bulkier.

In view of the foregoing, the image forming apparatus 100 according to the present embodiment includes an end LED discharger 80 (see FIG. 3), as a discharger different from the LED head 70.

Next, descriptions are given below of example methods for discharging the photoconductor 2 (the latent image bearer) usable in the above-described image forming apparatus 100 as well as example structures for the discharging.

Embodiment 1

Descriptions are given below of a discharge method for the photoconductor 2 and a discharge structure in the image forming apparatus 100 according to Embodiment 1, with reference to FIG. 3 and subsequent drawings.

Figure 3:
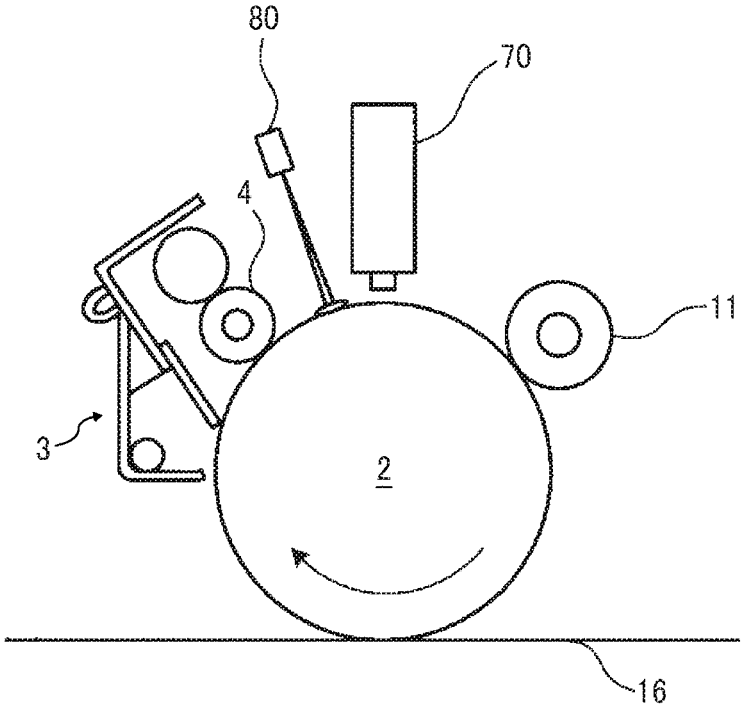
FIG. 3 is a cross-sectional view of components disposed around a photoconductor and relating to discharging by exposure, on a cross section perpendicular to a longitudinal direction of the photoconductor, according to Embodiment 1.

FIG. 3 is a cross-sectional view of components disposed around the photoconductor 2 and relating to the discharging by exposure, on a cross section perpendicular to the longitudinal direction (a main scanning direction) of the photoconductor 2.

Figure 4A:
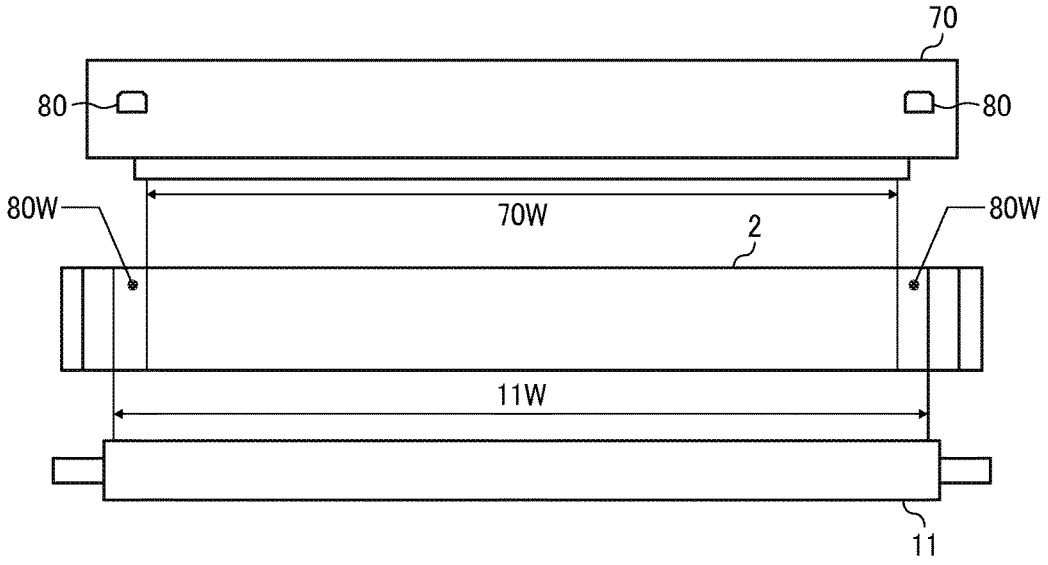
FIGS. 4A and 4B are schematic diagrams illustrating layout of the components disposed around the photoconductor and relating to the discharging by exposure, according to Embodiment 1.
Figure 4B:
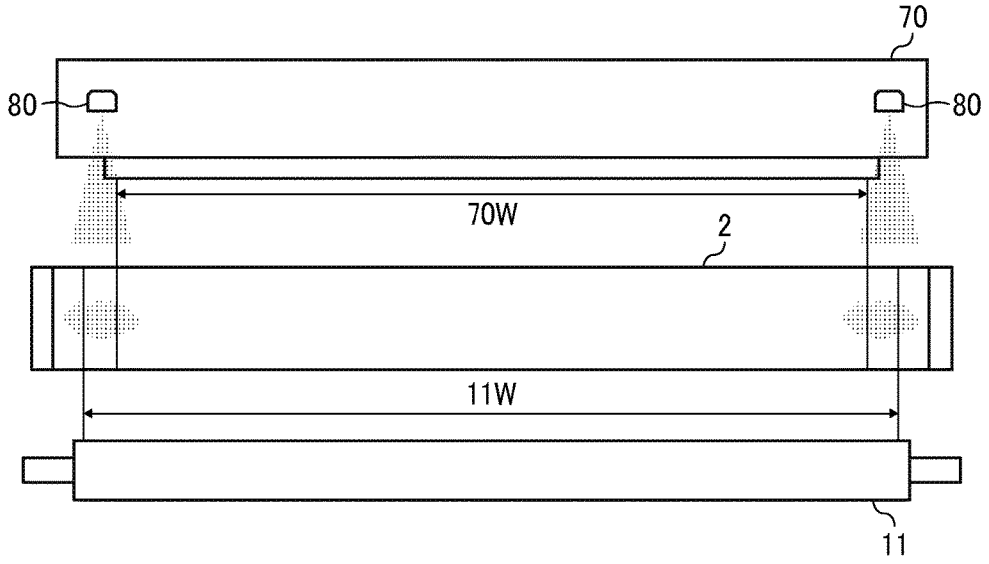

FIGS. 4A and 4B are schematic diagrams illustrating layout of the components disposed around the photoconductor 2 and relating to the discharging by exposure. FIG. 4A illustrates relations among a developing span 11W (the width of the developing range in the longitudinal direction of the photoconductor 2), a writing span 70W (the width of an exposure range by the LED head 70 in the longitudinal direction of the photoconductor 2), and out-of-writing ranges 80W, meaning ranges to be discharged by the end LED dischargers 80. The out-of-writing ranges 80W are located inside the developing span 11W and outside the writing span 70W (i.e., the exposure range). In the developing span 11W, the developer is borne on the developing roller 11. FIG. 4B illustrates locations of the end LED dischargers 80 to discharge the out-of-writing ranges 80W in the developing span 11W on the photoconductor 2. In the present embodiment, since center alignment is employed in sheet feeding, two end LED dischargers 80 are disposed on respective end sides in the longitudinal direction of the photoconductor 2. However, an image forming apparatus according to another embodiment may include a single end LED discharger 80.

As illustrated in FIG. 3, around the photoconductor 2, the charging roller 4, the LED head 70, the developing roller 11, and the photoconductor cleaning device 3 to remove the untransferred toner from the photoconductor 2 (untransferred onto the intermediate transfer belt 16) are disposed.

In addition, in the present embodiment, the end LED discharger 80 is disposed at a distance from the surface of the photoconductor 2. The end LED discharger 80 discharges, by exposure, the photoconductor 2, at a position between a charging position by the charging roller 4 and the exposure position (i.e., a latent image writing position) by the LED head 70, in the direction of rotation of the photoconductor 2. Specifically, the end LED discharger 80 discharges an end range (the out-of-writing range 80W) of the developing span 11W adjacent to the end of the developing span 11W in the longitudinal direction. In this specification, hereinafter "longitudinal direction" means that of the photoconductor 2 unless otherwise specified.

In the longitudinal direction of the photoconductor 2, as illustrated in FIG. 4A, when the developing span 11W (width in which developer is borne on the developing roller 11) is wider than the writing span 70W (width of exposure) by the LED head 70, the developing range includes areas outside the exposure range by the LED head 70.

The end LED dischargers 80 discharge, by exposure, the out-of-writing ranges 80W to alleviate background fog (background stain with toner) outside the exposure range exposed by the LED head 70.

Since the end LED discharger 80 performs exposure for discharging the range outside the writing span 70W irradiated by the LED head 70, the accuracy required for the exposure for discharging is not as strict as exposure for latent image writing. The end LED discharger 80 is lower in resolution than the LED head 70. The end LED discharger 80 is disposed at a position farther (higher in the present embodiment) from the photoconductor 2 than the LED head 70. Differently from the LED head 70 to irradiate the photoconductor 2 with light of high directivity, the end LED discharger 80 irradiates the photoconductor 2 with diffusion light to apply light to an area including an area not exposed for latent image writing (i.e., an unexposed area), thereby discharging the end area.

Since the end LED discharger 80 exposes the periphery of the unexposed area from a position further from the photoconductor 2 than the LED head 70, the end LED discharger 80 can discharge the unexposed area entirely, which changes with the positional deviations of the photoconductor 2, the developing roller 11, and the head holder 71 holding the LED head 70.

The end LED dischargers 80 discharge, by exposure, the out-of-writing ranges 80W outside the writing span 70W of the LED head 70 after a printing operation or after an adjustment operation of the image forming apparatus 100.

As described above, the method of discharging the photoconductor 2 according to Embodiment 1 is used in the image forming apparatus 100 that includes the photoconductor 2, the charging roller 4 to uniformly discharges the photoconductor 2, the LED head 70 employing an LED to expose the photoconductor 2 for forming an electrostatic latent image, and the developing device 5 to supply developer to the electrostatic latent image on the photoconductor 2 to develop the electrostatic latent image into a toner image.

The image forming apparatus 100 further includes the primary transfer roller 19, serving as the transfer device, to transfer the toner image onto the intermediate transfer belt 16, serving as the transfer medium. After the transferring by the primary transfer roller 19, the surface of the photoconductor 2 is discharged when rotation of the photoconductor 2 is stopped. In an image forming apparatus employing direct transferring, the transfer medium onto which the transfer device transfers the toner image is a recording medium (e.g., a paper sheet).

The image forming apparatus 100 further includes the end LED discharger 80, different from the LED head 70, to discharge the photoconductor 2. The LED head 70 discharges the exposure range (having the writing span 70W) exposed by the LED head 70. By contrast, the end LED dischargers 80 discharge the out-of-writing ranges 80W of the photoconductor 2 that are inside the developing span 11W and outside the writing span 70W in the longitudinal direction of the photoconductor 2.

With this configuration, the following effects are attained.

After the apparatus is left unused for a while, the surface potential of the photoconductor 2 is close to zero (0) volt at the activation of the developing device 5. Accordingly, in a case where the negatively charged toner is used, at the activation, a positive voltage is applied as the developing bias to the developing roller 11 of the developing device 5 so that the negatively charged toner is not used in image development.

In a case where the photoconductor 2 has a negative potential when the apparatus enters the standby or sleep mode or the apparatus is shut down, the potential difference is large in the developing range if a positive voltage is applied to the developing roller 11 at the subsequent activation of the apparatus. Then, unintended toner or undesirable toner adheres to the surface of the photoconductor 2. Accordingly, the toner adheres to the background area, which is a portion to be free of toner. As a result, toner falling or toner scattering inside the apparatus may occur.

An approach to suppress such inconveniences is increasing the writing span of an exposure device incorporating a light-emitting element to a size greater than the maximum sheet size in the main scanning direction. However, it is difficult to reduce the space required for installation of the exposure device and make the exposure device compact in the main scanning direction.

Accordingly, reduction of size of the image forming apparatus may be difficult.

As described above, reducing the space required for installation of the apparatus is difficult because structures (the holder of the photoconductor 2, the holder of the developing roller 11, the spacers between the photoconductor 2 and the LED head 70) necessary for the developing system are disposed dense in the end portions of the developing span 11W on the photoconductor 2 in the longitudinal direction thereof. Accordingly, it is difficult to extend the LED head 70 to the end portions of the developing span 11W on the photoconductor 2.

By contrast, in the method of discharging according to Embodiment 1, the LED head 70 and the end LED discharger 80 different from the LED head 70 are used. Accordingly, even when the writing span 70W of the LED head 70 is reduced to the maximum printing pattern width of the image forming apparatus 100, the developing span 11W on the photoconductor 2 can be entirely discharged.

Therefore, even when the writing span 70W of the LED head 70 is reduced to the maximum printing pattern width of the image forming apparatus 100, inconveniences such as adhesion of toner to the background area and falling of toner can be inhibited.

Additionally, even when the LED head 70 having a writing span (i.e., printing pattern width) smaller than the developing span 11W is used to discharge the photoconductor 2, the photoconductor 2 can be discharged to the end of the developing span 11W. Without extending the LED head 70, the conveniences such as adhesion of toner to the background area and toner falling can be inhibited.

Additionally, in the method of discharging the photoconductor 2 according to Embodiment 1, the end LED discharger 80 employs a light-emitting element such as an LED to discharge the photoconductor 2.

This structure facilitates reduction of size of the discharger. Further, contactless discharging can suppress the wear of the photoconductor 2 with elapse of time.

Additionally, in the method of discharging the photoconductor 2 according to Embodiment 1, the end LED discharger 80 can be configured so that the amount of light to exposure the photoconductor 2 is different from the amount of exposure light of the LED head 70.

With this configuration, the following effects are attained.

An aim of the discharging by the combination of the LED head 70 and the end LED discharger 80 is to discharge, entirely, the range outside the writing span 70W irradiated by the LED head 70. Accordingly, the accuracy required for the exposure for discharging is not as strict as exposure for latent image writing.

Accordingly, setting the distance from the discharger to the photoconductor 2 can be made more flexible by making the amount of light to expose the photoconductor 2 different between the LED head 70 and the end LED discharger 80. Then, the image forming apparatus 100 can be compact.

Additionally, in the method of discharging the photoconductor 2 according to Embodiment 1, the resolution of exposure light can be made different between the end LED discharger 80 and the LED head 70.

With this configuration, the following effects are attained.

As described above, the required accuracy of exposure by the end LED discharger 80 is not as strict as exposure for latent image writing since an aim of the end LED discharger 80 is to fully discharge the range outside the writing span 70W of the LED head 70.

Accordingly, in addition to setting the distance from the discharger to the photoconductor 2, setting the resolution of the end LED discharger 80 can be made more flexible by making the resolution in exposing the photoconductor 2 different between the end LED discharger 80 and the LED head 70. Then, the size and cost of the image forming apparatus 100 can be reduced.

Additionally, the distance between the photoconductor 2 and the end LED discharger 80 can be made greater than the distance between the photoconductor 2 and the LED head 70.

With this structure, the end LED discharger 80 can be disposed away from around the photoconductor 2, where the structures relating to the developing system are disposed dense. Then, reduction in size of the image forming apparatus 100 is easier.

Additionally, according to Embodiment 1, the span discharged by the end LED discharger 80 and the LED head 70 in combination is equal to or longer than the developing span 11W on the photoconductor 2 in the longitudinal direction thereof.

Accordingly, the entire developing span 11W on the photoconductor 2 can be discharged.

[Variation]

Although, in Embodiment 1 described above, the end LED dischargers 80 are disposed between the charging position by the charging roller 4 and the discharging position by the LED head 70 in the direction of rotation of the photoconductor 2 as illustrated in FIG. 3, the positions of the end LED discharger 80 are not limited thereto.

Descriptions are given below of positions of the end LED dischargers 80 according to variations of Embodiment 1, with reference to FIGS. 5A and 5B, which are cross-sectional views of the photoconductor 2 and the components disposed around the photoconductor 2.

Figure 5A:
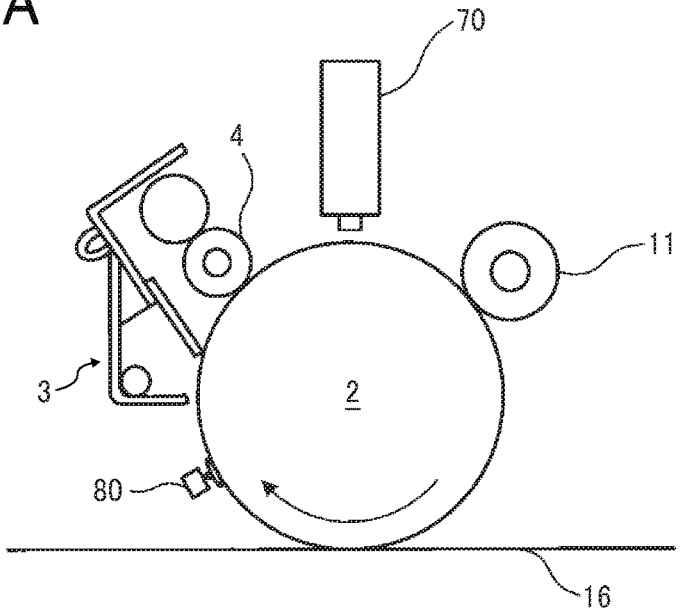
FIG. 5A is a cross-sectional view illustrating an arrangement of an end light-emitting diode (LED) discharger for discharging the photoconductor, according to a variation of Embodiment 1.
Figure 5B:
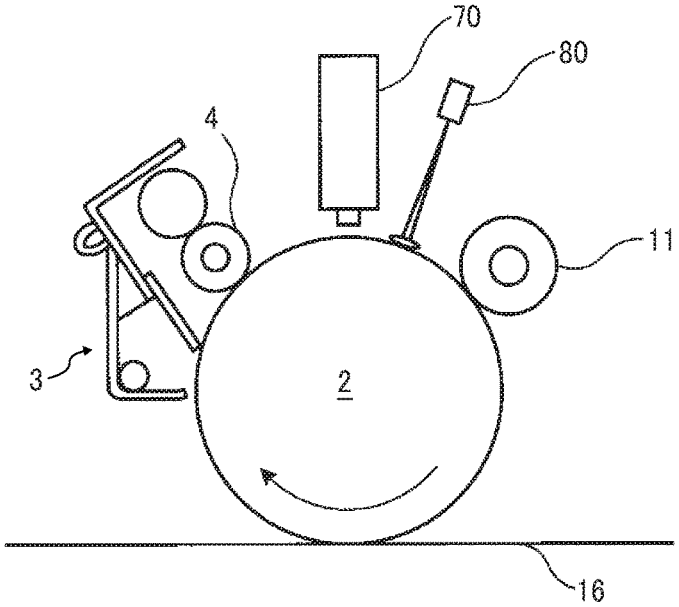
FIG. 5B is a cross-sectional view illustrating an arrangement of the end LED discharger according to another variation of Embodiment 1.

FIG. 5A illustrates an arrangement in which the end LED discharger 80 is disposed to discharge the photoconductor 2 at a position between the primary transfer nip (where the photoconductors 2 contacts the intermediate transfer belt 16) and the photoconductor cleaning device 3 in the direction of rotation of the photoconductor 2. FIG. 5B illustrates an arrangement in which the end LED discharger 80 is disposed to discharge the photoconductor 2 at a position between the discharging position by the LED head 70 and the developing position, where the developing roller 11 faces the photoconductor 2 in the direction of rotation of the photoconductor 2.

If the cost and the component layout permit, the end LED discharger 80 can be disposed at the position illustrated in FIG. 5A, to discharge the position between the primary transfer nip and the photoconductor cleaning device 3. Alternatively, the end LED discharger 80 can be disposed at the position illustrated in FIG. 5B, to discharge the position between the discharging position of the LED head 70 and the developing position.

Embodiment 2

Descriptions are given below of a method of discharging the photoconductor 2 and a discharge structure in the image forming apparatus 100 according to Embodiment 2.

In the method of discharging the photoconductor 2 according to Embodiment 2, timings of turning on the LED head 70 (the exposure device) and the end LED discharger 80 (the discharger) are specified, and the developing voltage, the charging voltage, and the transfer voltage are switched in response to the turning-on of the LED head 70 and turning-on of the end LED discharger 80.

Except the differences described above, the method of discharging the photoconductor 2 according to Embodiment 2, and the structure therefor, are similar to those according to Embodiment 1 described above. Therefore, descriptions of similar structures, and action and effects thereof are omitted to avoid redundancy. Unless it is necessary to distinguish, the same reference characters are given to the same or similar elements in the descriptions below.

Initially, descriptions are given below of use of the LED head 70 (i.e., the exposure device) for discharging the photoconductor 2, with reference to the drawings.

FIGS. 6A and 6B are schematic diagram of the photoconductor 2 and the components therearound on the cross section perpendicular to the axis of the photoconductor 2, with the surface potential of the photoconductor 2. Specifically, FIG. 6A illustrates the surface potential of the photoconductor 2 in a case where an adjustment operation and a printing operation are performed after a relatively long unused time. FIG. 6B illustrates the surface potential of the photoconductor 2 in a case where the photoconductor 2 is not discharged after printing operation.

In FIG. 6A, (a) illustrates the surface potential of the photoconductor 2 when the adjustment operation and the printing operation are started after a relatively long unused time, and (b) illustrates the surface potential of the photoconductor 2 when a charging start position P1 reaches the developing range. The charging start position P1 means a position on the surface of the photoconductor 2, where the charging is started. FIG. 6B illustrates the surface potential of the photoconductor 2 at the start of a printing operation in a case where the photoconductor 2 is not discharged in a previous printing operation.

In electrophotographic image forming apparatuses such as printers and copiers, as illustrated in FIG. 6A(a), in the case where the apparatus is left unused for a long time after a previous printing operation (a mechanical action), the surface potential of the photoconductor 2 becomes close to zero (0) volt due to dark decay.

Accordingly, as a developing bias voltage, a positive voltage (for example, +250 V) is applied to the developing roller 11 immediately after printing operation is started so that the negatively charged toner is not to be used in development.

Additionally, application of a negative voltage (as a charging bias voltage, for example, −1100 V) to the charging roller 4 is started as illustrated in FIG. 6A(a), after which the developing voltage is switched from the positive voltage to a negative voltage (for example, −250 V), as illustrated in FIG. 6A(b) at a timing at which the charging start position P1 on the surface of the photoconductor 2 reaches the developing range 11R facing the developing roller 11. Application of the negative voltage (developing bias voltage) is continued to the end of the mechanical action.

By contrast, it is assumed that the photoconductor 2 is not discharged in the previous operation, the surface potential of the photoconductor 2 is kept at a negative value (for example, −500 V) at the end of the previous operation as illustrated in FIG. 6B, and a subsequent operation is started immediately after completion of the previous operation.

In such a case, at the start of the subsequent operation, if a positive voltage (for example, +250 V) as the developing bias voltage is applied to the developing roller 11, the absolute value of the background potential becomes large (for example, −750 V).

In such a situation, consumption of toner may increase unexpectedly, or toner may scatter inside the apparatus.

To suppress such inconveniences, at the end of the operation, the photoconductor 2 is discharged in the entire developing span 11W to reduce the surface potential of the photoconductor 2 close to zero (0) volt.

Here, descriptions are given below of the background potential and the relation between the background potential and the amount of developer that adheres to the background area, with reference to the drawings.

Figure 7:
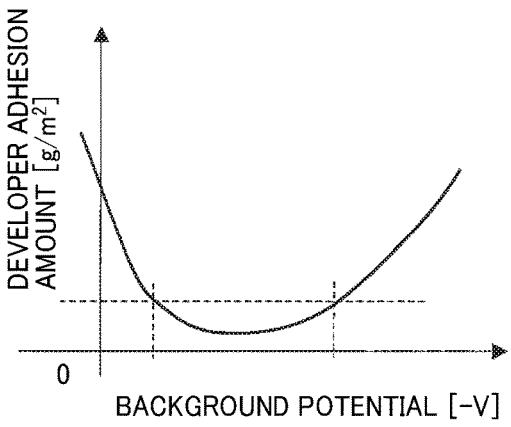
FIG. 7 is a graph illustrating a relation between background potential and the amount of developer that adheres to the photoconductor (i.e., developer adhesion amount)

FIG. 7 is a graph illustrating a relation between the background potential and developer adhesion amount, meaning the amount of developer that adheres to the photoconductor 2.

The background potential is defined as the difference between the surface potential of the latent image bearer, such as the photoconductor 2, and the developing potential. That is, the background potential is defined as the surface potential of the latent image bearer minus the developing bias voltage.

When the background potential is positive, the negatively charged toner adheres to the latent image bearer. On the contrary, when the background potential is large on the negative polarity side, the developer adhesion amount increases in some cases. Accordingly, in Embodiment 2, the background potential is set at −100 V to −300 V in a situation in which reduction in toner adhesion amount is desirable.

Next, descriptions are given below of a sequence of discharging (by exposure) the photoconductor 2 in a case where only the LED head 70 (the exposure device) is used for the discharging, with reference to FIGS. 8A and 8B.

Figure 8A:
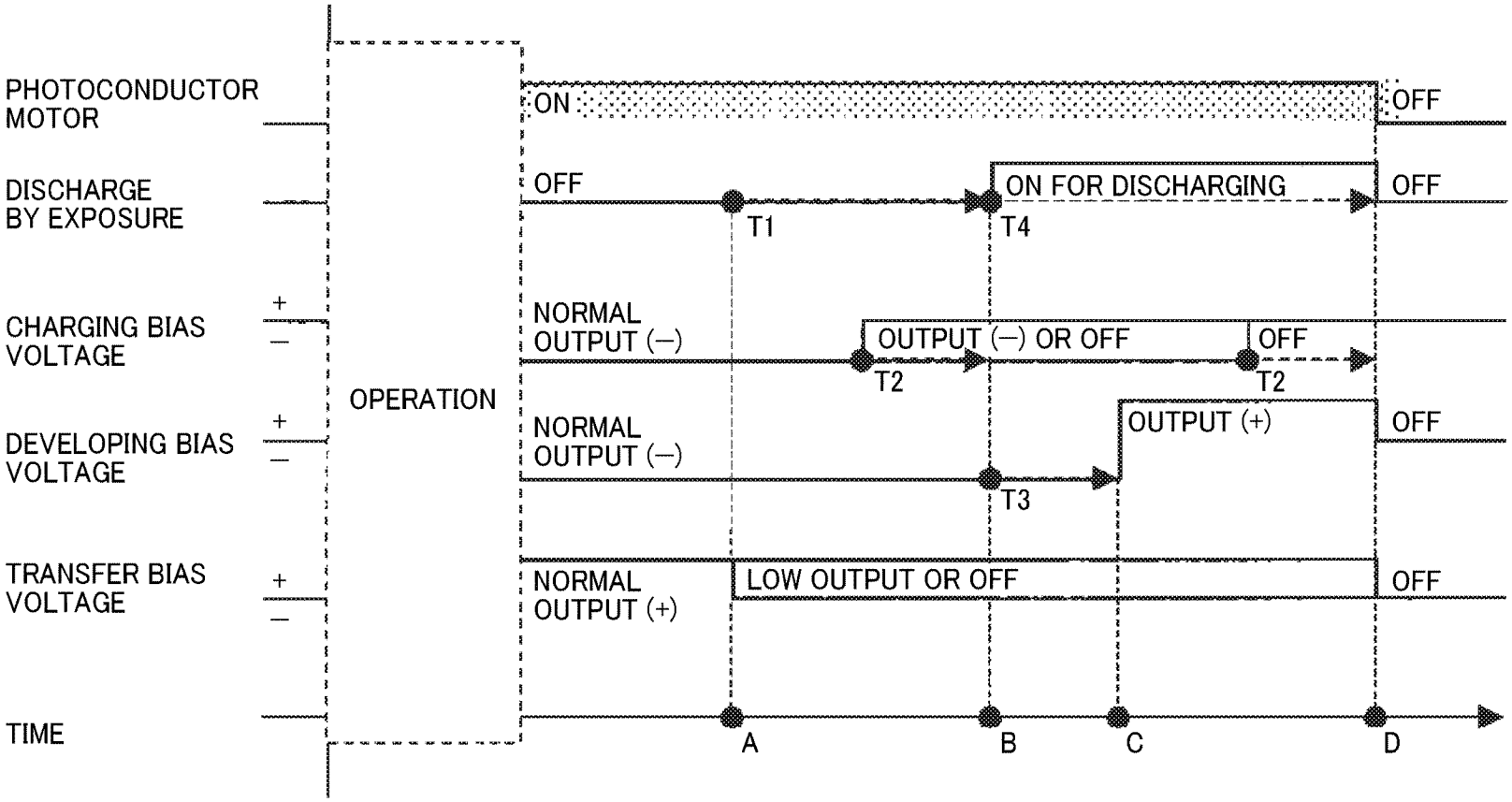
FIGS. 8A and 8B are timing charts of a sequence of photoconductor discharge according to a comparative example, using the LED head serving as an exposure device.

FIG. 8A is a timing chart of a sequence of discharging in a case where flexibility is allowed in setting of application of charging bias voltage and application of transfer bias voltage (i.e., the primary transfer bias). FIG. 8B is a timing chart of a sequence of discharging in a case where output of the charging bias voltage is turned off when a discharging start point, meaning a given point on the photoconductor 2 at which the discharging is started, reaches the position to be discharged by the LED head 70.

Figure 8B:
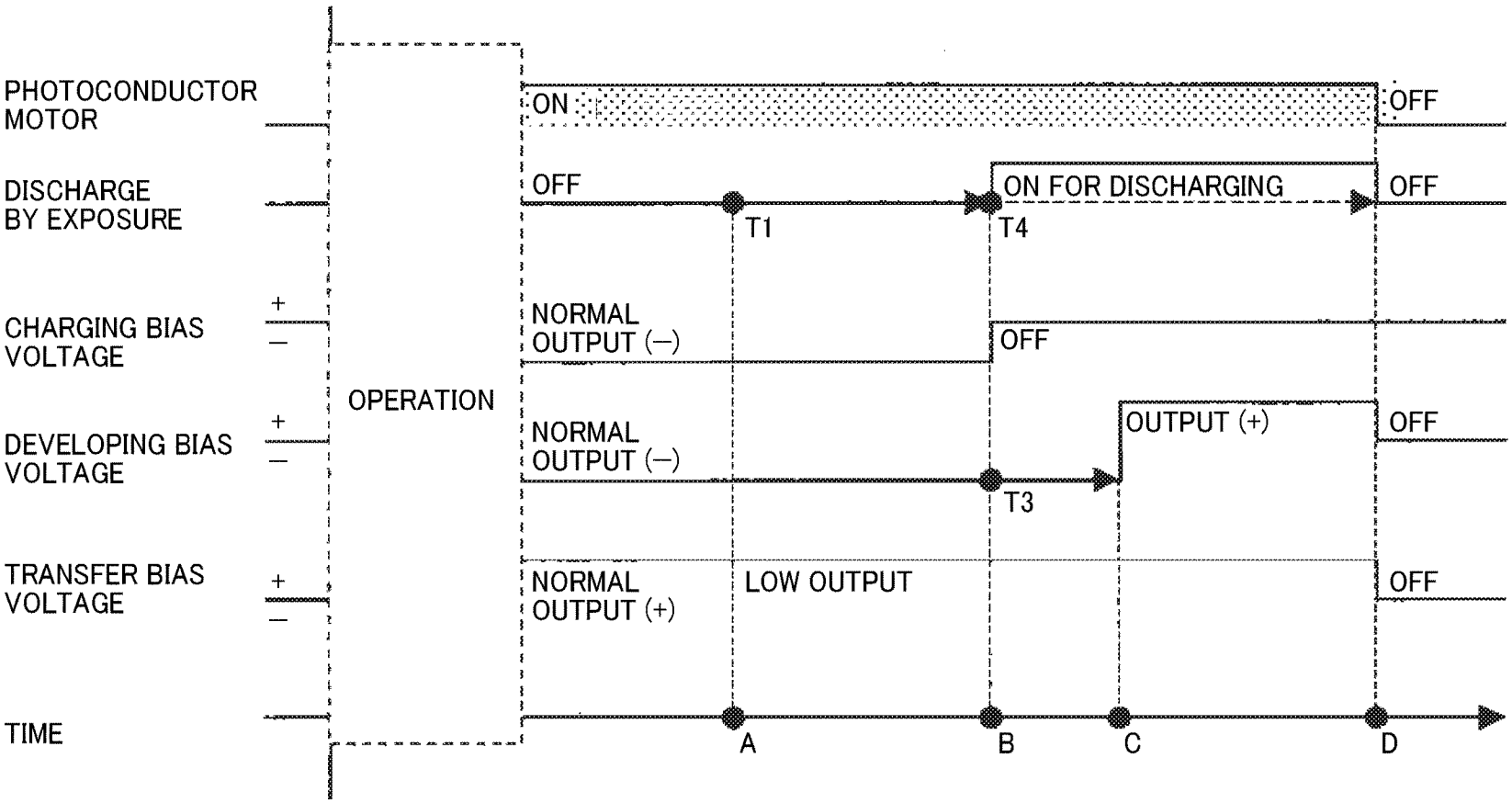

In FIGS. 8A and 8B, the controller 90 illustrated in FIG. 1 starts a sequence of discharging (by exposure) the photoconductor 2 at Time point A, at which the discharging start point on the photoconductor 2 by the LED head 70 is in the transfer area (i.e., the transfer nip 19N illustrated in FIG. 6A). At Time point B, the discharging start point reaches a discharge area by the LED head 70, and the LED head 70 is turned on for discharging. At Time point C, the discharging start point reaches the developing range 11R. At Time point D, a time required for the photoconductor 2 to make a full turn plus extra has elapsed from Time point B, at which the discharging start point is discharged.

Additionally, Time T1 in FIGS. 8A and 8B represents the duration (from Time point A to Time point B) for the discharging start point to move from the transfer area (the transfer nip 19N) to the discharge area by the LED head 70. Time T2 represents the duration for the discharging start point to move from the charging area to the discharge area. Time T3 represents the duration (from Time point B to Time point C) for the discharging start point to move from the discharge area to the developing range 11R. Time T4 (from Time point B to Time point D) represents the duration for the discharging start point to move by a distance equivalent to the length of circumference of the photoconductor 2 plus extra.

Before the controller 90 starts the sequence of discharging by exposure, the printing operation or the adjustment operation is performed (simply "Operation" in FIGS. 8A and 8B). In the printing operation or the adjustment operation, the LED head 70 is turned off, application of charging bias voltage is set to normal output of negative (−) voltage, application of developing bias voltage is set to the normal output of negative (−) voltage, application of transfer bias voltage is set to the normal output of positive (+) voltage, and the photoconductor motor is driven.

In the example illustrated in FIG. 8A, the photoconductor motor is turned on during the printing operation or the adjustment operation and turned off at Time point D.

The LED head 70 ("discharge by exposure" in FIGS. 8A and 8B) is turned on for discharging at Time point B, at which the discharging start point arrives at the discharge area by the LED head 70, and the discharge by exposure is turned off at Time point D.

The application of charging bias voltage is switched from the normal output of negative (−) voltage to off at a time point going back by Time T2 (the duration for the discharging start point to move from the charging area to the discharge area) from either Time point B or Time point D.

The application of developing bias voltage is switched to output of positive (+) voltage, opposite the normal output, at Time point C, at which the discharging start point reaches the developing range 11R. The developing bias voltage is turned off at Time point D.

The transfer bias voltage (e.g., the primary transfer bias) is switched from the normal output of positive (+) voltage to off at Time point A, at which the discharging start point reaches the transfer area (the transfer nip 19N). Alternatively, the application of transfer bias voltage is switched to "LOW" output. Then, the transfer bias voltage is turned off at Time point D, at which the sequence of discharging by exposure ends (the photoconductor 2 has rotated for a full turn plus extra from when the discharging start point is discharged).

In the example illustrated in FIG. 8A, flexibility is allowed in setting the application of charging bias voltage and the application of transfer bias voltage as described above.

The example illustrated in FIG. 8B is different from the example illustrated in FIG. 8A as follows.

The application of charging bias voltage is switched from the normal output of negative (−) voltage to off at Time point B, at which the discharging start point reaches the discharge area.

The timing of switching of the transfer bias voltage is not flexible. The application of transfer bias voltage is switched from the normal output of positive (+) voltage to "LOW" output at Time point A, at which the discharging start point reaches the transfer area (the transfer nip 19N). Then, the transfer bias voltage is turned off at Time point D, at which the sequence of discharging by exposure ends (the photoconductor 2 has rotated for a full turn plus extra from when the discharging start point is discharged).

If the LED head 70 can discharge the entire developing span 11W on the photoconductor 2 using one of the example sequence of photoconductor discharge illustrated in FIG. 8A and the sequence illustrated in FIG. 8B, the photoconductor 2 can be discharged preferably.

However, the maximum writing span (printing pattern width) of the LED head 70, which is an exposure device for forming a latent image, is generally narrower than the developing span 11W. In such a case, the developing span 11W on the photoconductor 2 is not entirely discharged with only the LED head 70.

Therefore, in the Embodiment 1 described above and the present embodiment, the end LED discharger 80, another discharger, is disposed to discharge the area outside the area exposed by the LED head 70.

Here, descriptions are given in further detail of the layout of the components disposed around the photoconductor 2 and relating to the developing system. The layout, which is described above with reference to FIGS. 3, 4A, and 4B in Embodiment 1, is again described using a simplified drawing in FIGS. 9A and 9B.

Figure 9A:
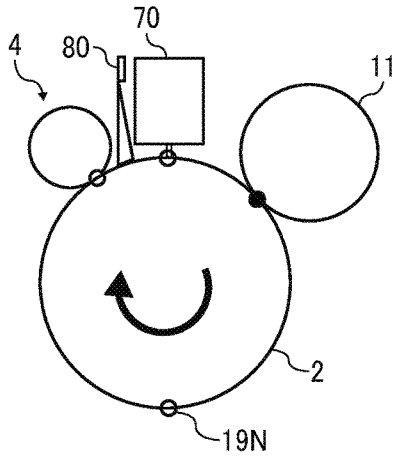
FIGS. 9A and 9B are schematic diagrams illustrating layout of the components disposed around the photoconductor and relating to the discharging by exposure, according to Embodiment 2.
Figure 9B:
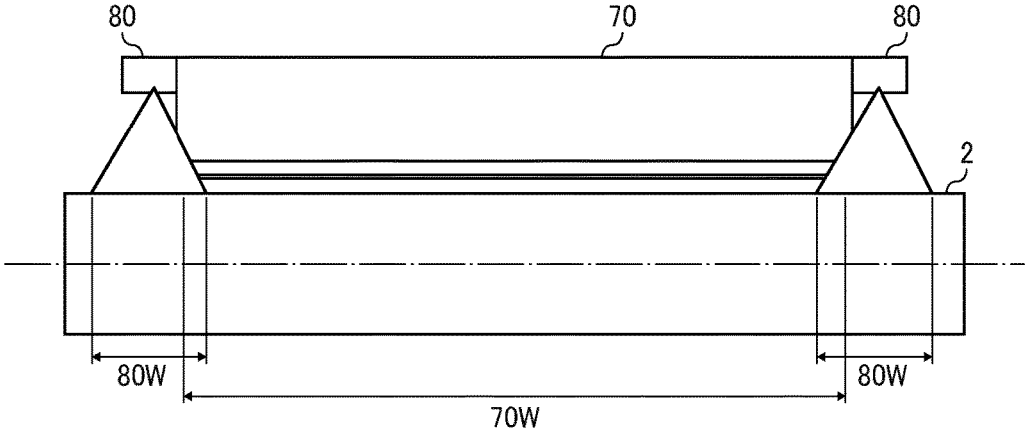

FIG. 9A is schematic view illustrating the component layout around the photoconductor 2 according to Embodiment 2, on a cross section perpendicular to the longitudinal direction of the photoconductor 2. FIG. 9B is a schematic side view illustrating the component layout in the longitudinal direction of the photoconductor 2.

In Embodiment 2, to discharge the photoconductor 2, the LED head 70 serving as the exposure device for forming a latent image (printing pattern) and the end LED discharger 80 to discharge the area outside the exposure span of the LED head 70 are used as illustrated in FIGS. 9A and 9B.

The end LED discharger 80 is disposed, preferably, next to (downstream or upstream from) the LED head 70 in the direction of rotation of the photoconductor 2.

In Embodiment 2, the end LED discharger 80 is disposed upstream from the LED head 70 in the direction of rotation of the photoconductor 2 as illustrated in FIG. 9A, and attached to the head holder 71 holding the LED head 70 as illustrated in FIG. 1. Further, as illustrated in FIG. 9B, the end LED discharger 80 is disposed such that the areas (the out-of-writing ranges 80W) discharged by the end LED discharger 80 overlap with the area (the writing span 70W) discharged by the LED head 70 in the end portions of the longitudinal direction of the photoconductor 2.

In the arrangement illustrated in FIGS. 9A and 9B, in the direction of rotation of the photoconductor 2 (in which the surface thereof moves), the LED head 70, serving as the exposure device, and the end LED dischargers 80, which are to discharge the end portions of the photoconductor 2 in the longitudinal direction of the photoconductor 2, are disposed at different positions from each other.

In such an arrangement, if the discharge start timing of the LED head 70 and the discharge start timing of the end LED discharger 80 are improper, variations are large regarding discharge start ranges in the longitudinal direction of the photoconductor 2, depending on start timings of the discharge by the LED head 70 and the end LED discharger 80 performed at the end of operation.

If the variations are large, there is a risk that an undischarged portion of the surface of the photoconductor 2, not discharged by either of the LED head 70 and the end LED discharger 80, stops in the developing range 11R, thereby degrading, partly in the main scanning direction of the latent image bearer, the effect of suppressing the inconveniences such as adhesion of toner to the background area and toner falling.

In view of the foregoing, in the method of discharging the photoconductor 2 according to Embodiment 2, regarding the discharging at the end of the operation, the discharge start timing of the LED head 70 and that of the end LED discharger 80 are adjusted to align the discharge start ranges in the longitudinal direction of the photoconductor 2, thereby inhibiting the adhesion of toner to the background area, toner falling, and toner scattering inside the apparatus.

Figure 10:
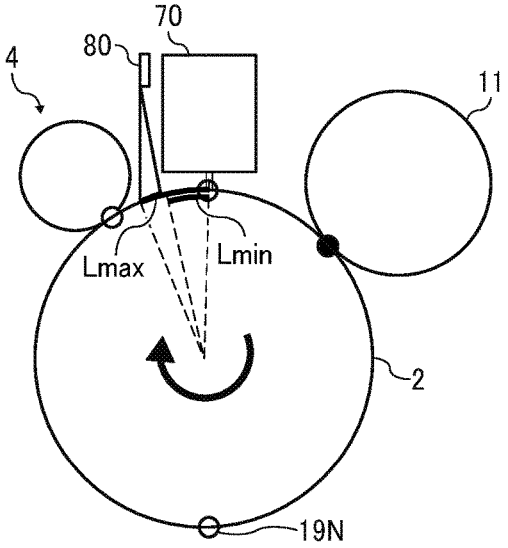
FIG. 10 is a schematic cross-sectional view of the photoconductor and the adjacent components to illustrate a discharge area by the LED head and that by the end LED discharger, a distance therebetween, and a rotation speed of the photoconductor, according to Embodiment 2.

Referring to FIG. 10, descriptions are given below of a relation among the discharge area by the LED head 70 and that by the end LED discharger 80 in the direction of rotation of the photoconductor 2, the distance therebetween, and the rotation speed of the photoconductor 2 (surface movement speed of the photoconductor 2).

FIG. 10 is a schematic cross-sectional view of the photoconductor 2 and the adjacent components, together with the distance therebetween the discharge area by the LED head 70 and that by the end LED discharger 80, according to Embodiment 2.

In FIG. 10, a distance Lmax (in millimeters) is the distance between an upstream end of the discharge area by the end LED discharger 80 and the discharge area by the LED head 70 on the photoconductor 2 in the direction of rotation of the photoconductor 2.

A distance Lmin (in millimeters) represents the distance between a downstream end of the discharge area by the end LED discharger 80 and the discharge area by the LED head 70 on the photoconductor 2 in the direction of rotation of the photoconductor 2.

The rotation speed of the photoconductor 2 (the linear speed at which the surface of the photoconductor 2 moves) is referred to as "speed V" in millimeters per second, and the duration from when the end LED discharger 80 starts discharging to when the LED head 70 starts discharging is referred to as "time T" in seconds.

In order to align the discharge area of respective discharge start ranges of the LED head 70 and the end LED discharger 80 in the longitudinal direction of the photoconductor 2, the end LED discharger 80 starts discharging at a timing earlier, by a period defined as Lmin/V=T, than the start of discharge by the LED head 70.

However, keeping the accuracy in layout of the photoconductor 2, the end LED discharger 80, and the LED head 70 and the accuracy in the rotation speed of the photoconductor 2 is difficult in, not only in manufacture of the image forming apparatus 100, but also in operation thereof.

Therefore, in the method of discharging the photoconductor 2 according to Embodiment 2, the relation defined in Formula 1 is satisfied.

$$Lmin \leq V \cdot T \leq Lmax \qquad \text{Formula 1}$$

When the distance Lmin, the distance Lmax, the rotation speed V, and the time T are set to satisfy the relation defined in Formula 1, the discharge start timing of the LED head 70 and the discharge start timings of the end LED discharger 80 at the end of operation can be adjusted to suppress the variations in the discharge start ranges in the longitudinal direction of the photoconductor 2.

Such suppression can alleviate the above-described inconvenience that an undischarged portion of the surface of the photoconductor 2, not discharged by either of the LED head 70 and the end LED discharger 80, stops in the developing range 11R, thereby degrading, partly in the main scanning direction of the latent image bearer, the effect of suppressing adhesion of toner to the background area and toner falling.

Therefore, even when the writing span 70W of the LED head 70 is reduced to the maximum printing pattern width of the image forming apparatus 100, inconveniences such as adhesion of toner to the background area and falling of toner can be better inhibited.

Next, descriptions are given below of a sequence of photoconductor discharge using the LED head 70, which is the exposure device for forming a latent image, and the end LED dischargers 80 to expose the area outside the writing span 70W of the LED head 70, using a plurality of examples, with reference to the drawings.

Figure 11A:
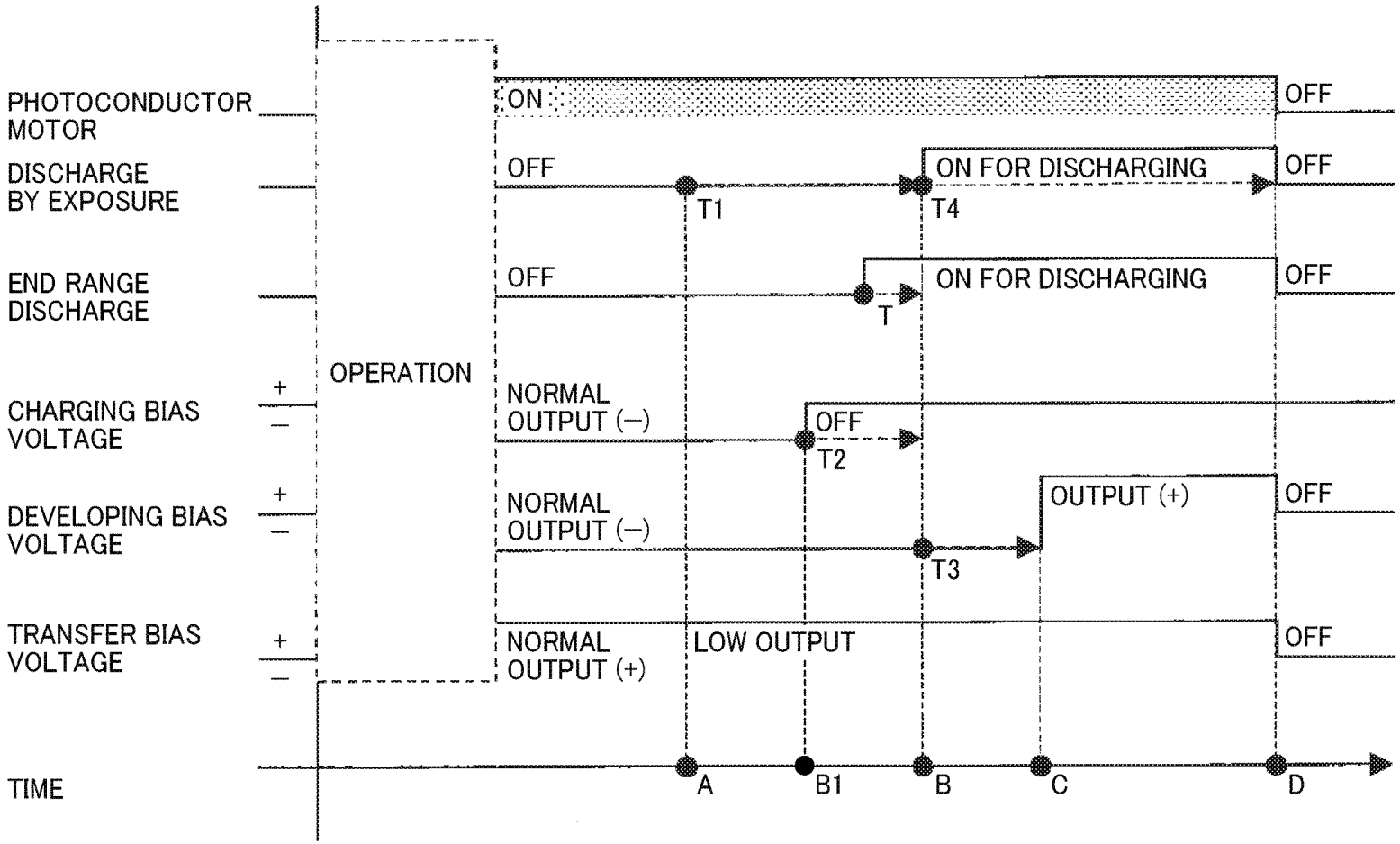
FIG. 11A is a timing chart of the sequence of discharging according to Example 1.
Figure 11B:
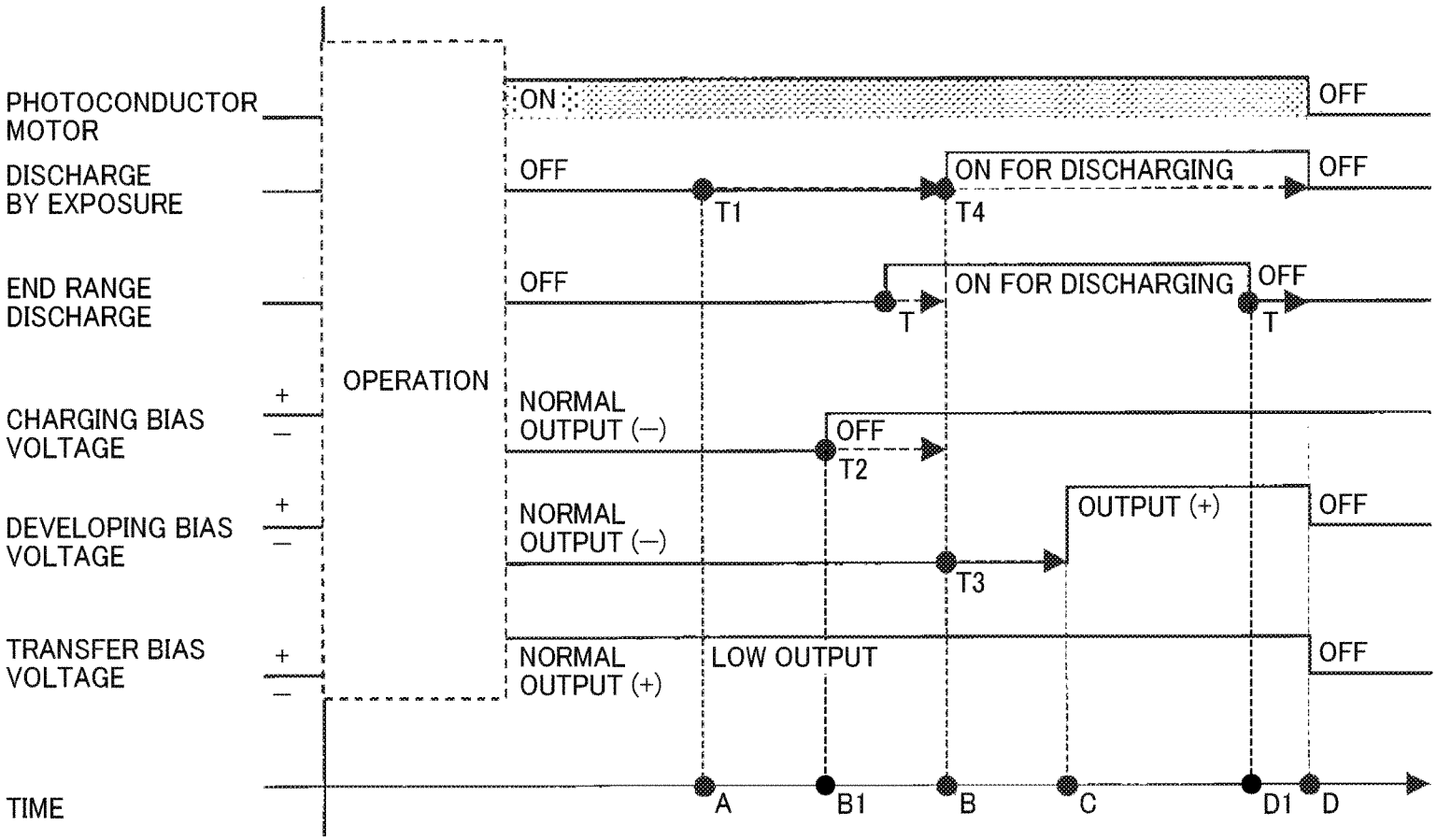
FIG. 11B is a timing chart of the sequence of discharging according to Example 2.
Figure 12A:
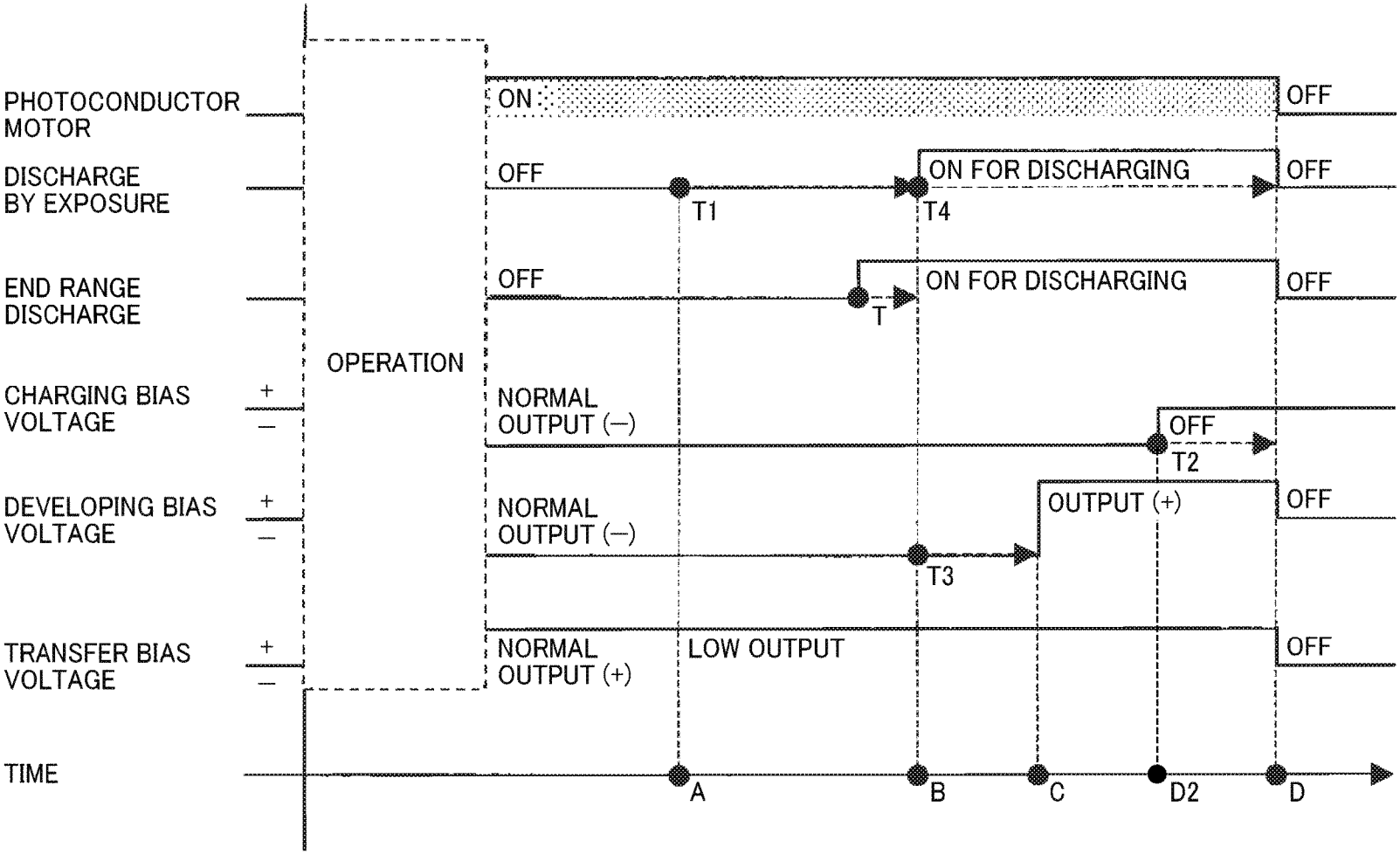
FIG. 12A is a timing chart of the sequence of photoconductor discharge according to Example 3.
Figure 12B:
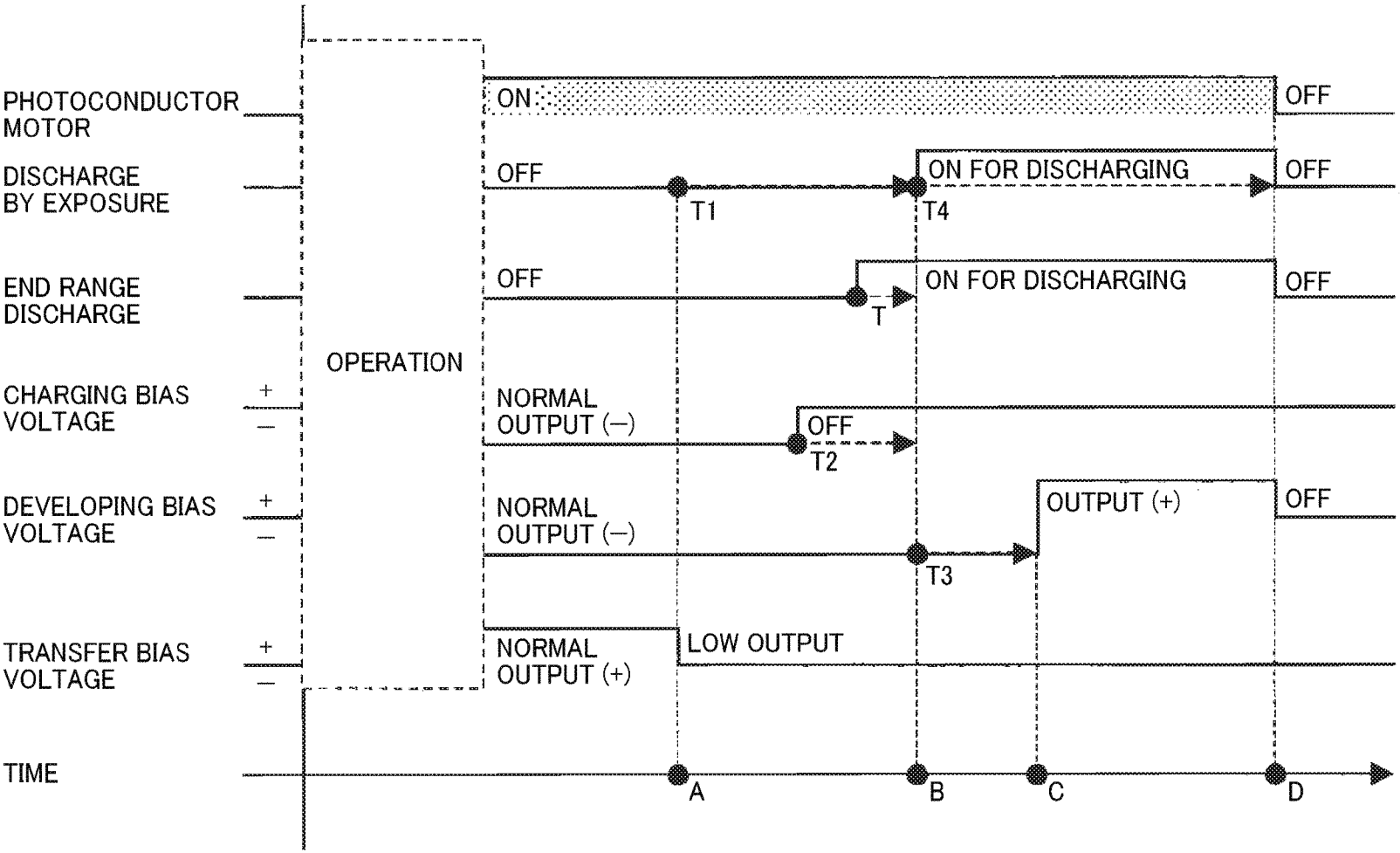
FIG. 12B is a timing chart of a sequence of photoconductor discharge according to Example 4.
Figure 13:
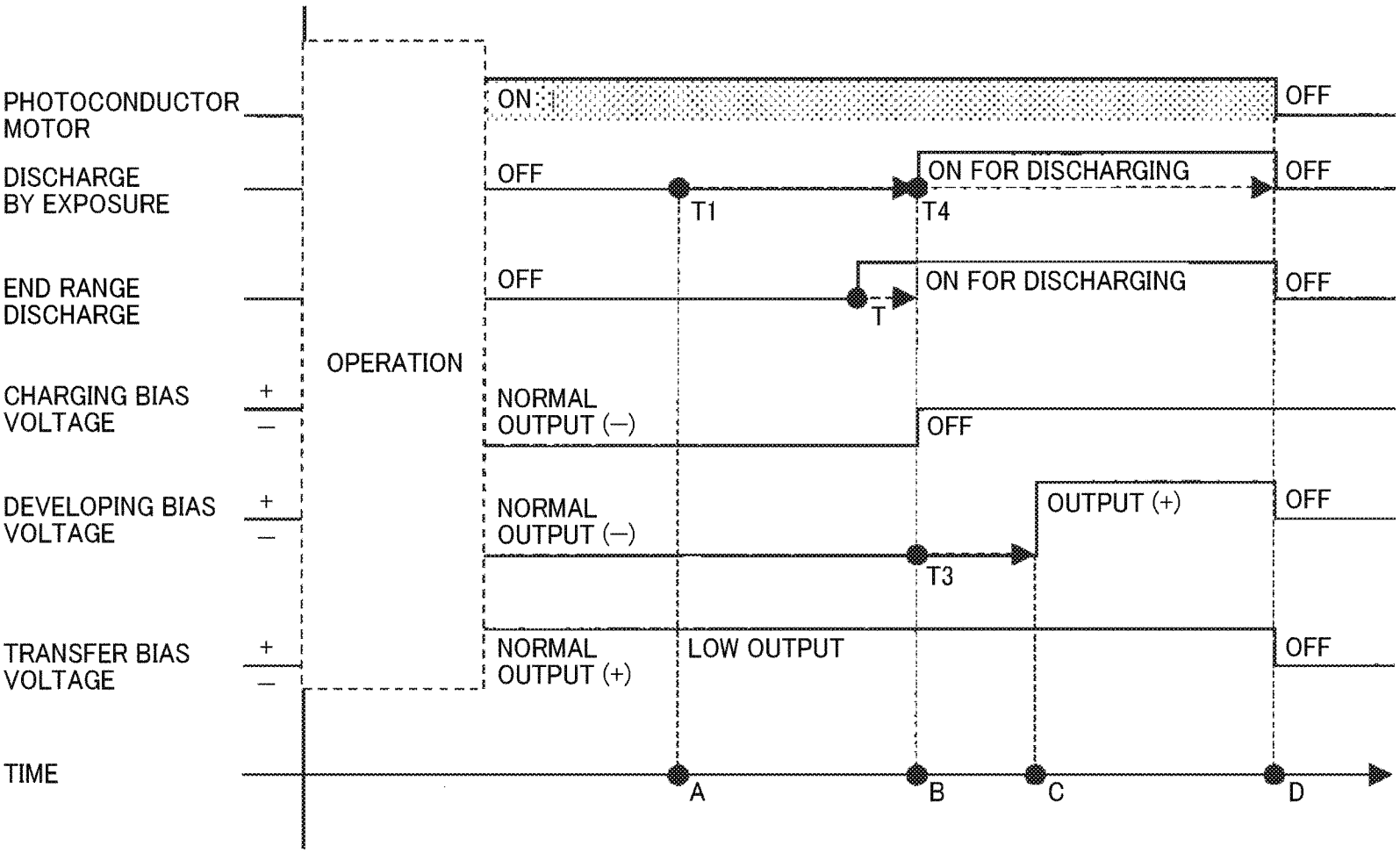
FIG. 13 is a timing chart of a sequence of photoconductor discharge according to Example 5.

FIGS. 11A, 11B, 12A, 12B, and 13 are timing charts of the examples of the sequence of photoconductor discharge, according to Embodiment 2. FIG. 11A is a timing chart of the sequence of photoconductor discharge according to Example 1, and FIG. 11B is a timing chart of the sequence of photoconductor discharge according to Example 2. FIG. 12A is a timing chart of the sequence of photoconductor discharge according to Example 3, and FIG. 12B is a timing chart of the sequence of photoconductor discharge according to Example 4. FIG. 13 is a timing chart of the sequence of photoconductor discharge according to Example 5.

In the description below, structures and configurations similar to those of the sequence of photoconductor discharge using only the LED head 70, described with reference to FIGS. 8A and 8B, are omitted to avoid redundancy.

Example 1

Descriptions are given below of the sequence of discharging according to Example 1 of Embodiments 2.

In the example illustrated in FIG. 11A, similar to the sequence described with reference to FIG. 8A, the LED head 70 is turned on for discharging at Time point B, at which the discharging start point arrives at the discharge area by the LED head 70, and the discharging by the LED head 70 is turned off at Time point D.

By contrast, the end LED discharger 80 starts discharging (i.e., end range discharge in FIGS. 11A through 13) at a timing earlier, by a period defined as Lmin/V=T, than the start of discharge by the LED head 70 at Time point B. Specifically, the end LED discharger 80 is turned on at a timing at which the discharging start point by the end LED discharger 80 arrives at the discharge area by the end LED discharger 80. The end LED discharger 80 is turned off at Time point D.

Similar to the sequence illustrated in FIG. 11A, the application of charging bias voltage can be switched from the normal output of negative (−) voltage to off when the discharging start point by the LED head 70 reaches the charging area. That is the charging bias voltage can be turned off at Time point B1, earlier by Time T2 than Time point B. Alternatively, the application of charging bias voltage can be switched from the normal output of negative (−) voltage to "LOW" output and then is turned off at Time point D.

Similar to the sequence illustrated in FIG. 8A, the developing bias voltage is switched to positive (+) side, opposite the normal output, at a timing at which the discharging start point by the LED head 70 reaches the developing range. The developing bias voltage is turned off at Time point D. Note that, in order to prevent the negatively charged toner from being used in developing, it is necessary to switch the application of developing bias voltage from negative (−) output to positive (+) output after elapse of Time T3 from Time point B. Time T3 is the time required for the photoconductor 2 to rotate by the distance from the discharge area by the LED head 70 to the developing range.

The transfer bias voltage (e.g., the primary transfer bias) is switched from the normal output of positive (+) voltage to "LOW" output at Time point A, at which the discharging start point by the LED head 70 reaches the transfer area (the transfer nip 19N). Then, the transfer bias voltage is turned off at Time point D, at which the sequence of photoconductor discharge ends (the photoconductor 2 has rotated for once plus extra from when the discharging start point is discharged).

The timings of operations of the photoconductor motor and the timings of the application of transfer bias voltage are similar to those illustrated in FIG. 8A.

The LED head 70 starts irradiation (discharge by exposure) at Time point B, after elapse of Time T1 (for the photoconductor 2 to rotate by a distance from the transfer range to the discharge area by the LED head 70) from Time point A, at which the sequence of photoconductor discharge starts.

The end LED discharger 80 starts the exposure earlier by Time T from Time point B. That is, Time T is the duration from the exposure start of the end LED discharger 80 to the exposure start of the LED head 70. Such timing adjustment can suppress variations in the discharge start position between the end portion and a center portion in the longitudinal direction of the photoconductor 2.

After Time point B, the sequence ends after elapse of Time T4, during which a given position on the surface of the photoconductor 2 moves by one rotation plus extra. In Embodiment 2, "plus extra" is a period equivalent to, for example, 5 mm to 10 mm when the length of circumference of the photoconductor 2 is 94 mm.

Example 2

Descriptions are given below of the sequence of discharging according to Example 2 of Embodiments 2.

The sequence of photoconductor discharge according to Example 2 is different from Example 1 regarding the timing at which the end LED discharger 80 is turned off. That is, in Example 2 illustrated in FIG. 11B, the end LED discharger 80 stops exposing at a timing different from the exposure stop timing in Example 1 described above.

Specifically, as illustrated in FIG. 11B, the end LED discharger 80 can stop exposing (discharging) at Time point D1, which occurs after the surface of the photoconductor 2 moves by one rotation plus extra from the start of exposing (discharging) by the end LED discharger 80. Alternatively, the discharger 80 can stop exposing (discharging) at a given time point between Time point D1 and Time point D.

Example 3

Descriptions are given below of the sequence of discharging according to Example 3 of Embodiments 2.

The sequence of photoconductor discharge according the present example is different from Example 1 in that the timing at which the application of charging bias voltage is turned off or switched to "LOW" output.

In Example 3 illustrated in FIG. 12A, the application of charging bias voltage is turned off at a timing earlier by Time T2 from Time point D. Time T2 is the duration for the discharging start point on the photoconductor 2 by the LED head 70 to move from the charging area to the discharge area by the LED head 70. Alternatively, the application of charging bias voltage is weakened at Time point D2 and turned off at Time point D.

The timing of turning off the application of charging bias voltage is as follows. As in Example 1 and Example 2, the application of charging bias voltage can be switched to "LOW" output or turned off after Time point B1 (illustrated in FIGS. 11A and 11B), which is earlier by Time T2 from Time point B, and it is necessary to turn off the application of charging bias voltage at Time point D2, which is earlier by Time T2 than Time point D. This timing setting is to discharge (not to charge) the photoconductor 2. In other words, the timing of turning off the application of charging bias voltage can be set at a given time point between Time point B1 illustrated in FIG. 11A and Time point D2 illustrated in FIG. 12A.

Example 4

Descriptions are given below of the sequence of discharging according to Example 4 of Embodiments 2.

The sequence of photoconductor discharge according the present example is different from Example 1 regarding the timing of turning off the application of the transfer bias (e.g., the primary transfer bias).

In the example illustrated in FIG. 12B, the application of transfer bias voltage (e.g., the primary transfer bias) is switched from the normal output of positive (+) voltage to off at Time point A, at which the discharging start point by the LED head 70 reaches the transfer area (the transfer nip 19N).

The transfer bias (e.g., the primary transfer bias) can be turned off at or after Time point A as in Example 4 illustrated in FIG. 12B. Alternatively, the transfer bias can be switched to "LOW" at or after Time point A as in Example 1, 2, and 3. This timing is to make the primary transfer voltage to excessively positive (+), thereby preventing the surface potential of the photoconductor 2 from being charged to positive (+) side.

Example 5

Descriptions are given below of the sequence of discharging according to Example 5 of Embodiments 2.

The sequence of photoconductor discharge according the present example is different from Example 1 regarding the timing of switching the application of charging bias voltage. The timing of switching the application of charging bias voltage in the present example is different from such timings in Examples 2, 3, and 4.

In the example illustrated in FIG. 13, the timing of switching the application of charging bias voltage is set to Time point B to reduce the number of trigger actions, aiming at reducing the load on software processing.

Next, descriptions are given below of characteristics of potential of the photoconductor 2 usable in Embodiment 2.

Figure 14A:
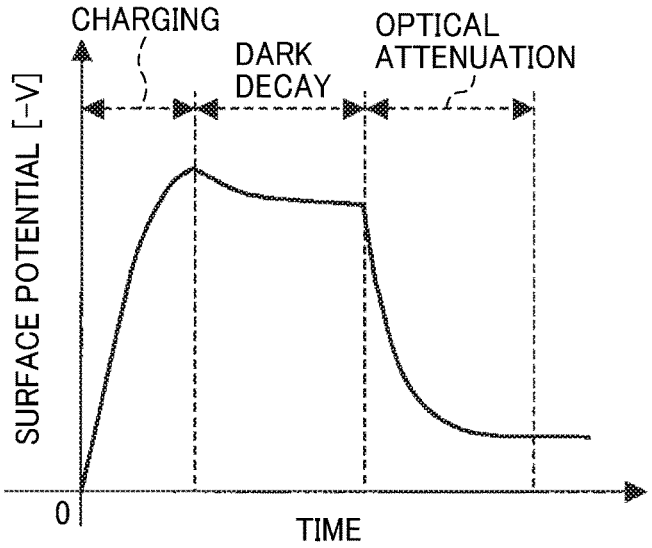
FIG. 14A is a graph of changes in the surface potential of the photoconductor with time according to Embodiment 2.
Figure 14B:
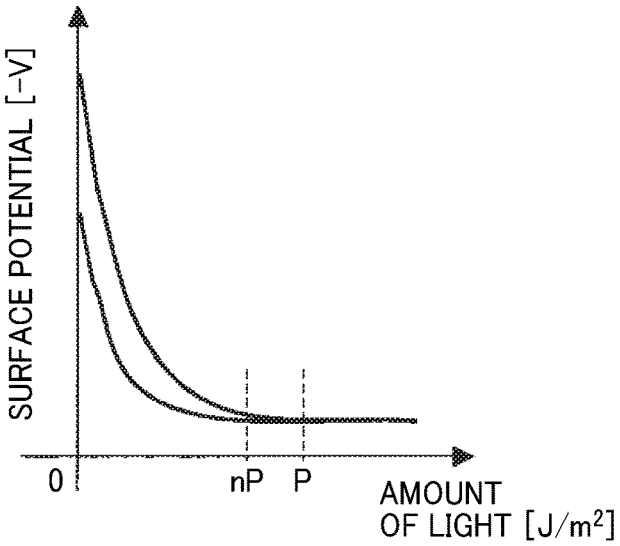
FIG. 14B is a graph of changes in the surface potential of the photoconductor with changes in the amount of light in discharging by exposure.

FIG. 14A is a graph of changes in the surface potential of the photoconductor 2 with time according to Embodiment 2. FIG. 14B is a graph of changes in the surface potential of the photoconductor 2 with changes in the amount of light in discharging by exposure.

Regarding the surface potential of the photoconductor 2, it is known that, as illustrated in FIG. 14A, the photoconductor 2 bears negative (−) potential as the charging bias voltage is applied thereto. Subsequently, dark decay occurs, and the surface potential slightly approaches to zero (0) volt without application of light by the LED head 70 or the end LED discharger 80. With the application of light by the LED head 70 or the end LED discharger 80, optical attenuation occurs, and the surface potential abruptly approaches to zero (0) volt.

The amount with which the photoconductor 2 is exposed by the LED head 70 or the end LED discharger 80, used in the method of discharging the photoconductor 2 according to Embodiment 2, is set to an amount (such as the amount P in FIG. 14B) to attain sufficient optical attenuation under a condition that the photoconductor 2 is at a fastest speed in mechanical action.

The photoconductor 2 being at the fastest speed is a state in which the photoconductor 2 rotates at the fastest speed and the time of exposure by the LED head 70 and that by the end LED discharger 80 are shortest such that the exposure energies thereof are smallest.

Note that the exposure range (for exposing the photoconductor 2) by the LED head 70 is about 50 μm to 100 μm in each spot diameter, while the exposure range of the end LED discharger 80 is in millimeter-scale (e.g., in Embodiment 2, about 1 to 2 mm in the direction of rotation of the photoconductor 2). Thus, the exposure range of the end LED discharger 80 is wider (about 20 times larger) than that of the LED head 70.

While the photoconductor 2 passes through the exposure ranges, the photoconductor 2 receives light energy such as the amount P of light in FIG. 14B from the light sources. Thus, the surface potential thereof decreases.

There are cases where the surface potential of the photoconductor 2 is close to zero (0) volt even when the surface of the photoconductor 2 has traveled in the exposure range by a distance n ($0 \leq n \leq 1$) and the amount of light received by the photoconductor 2 is an amount nP.

Accordingly, a supposed discharge completion point in the exposure range by the end LED discharger 80, meaning a point at which the discharge of the photoconductor 2 is supposed to complete, is located between the extreme upstream point and the extreme downstream point of the exposure range of the end LED discharger 80.

Next, descriptions are given below of degradation with time of the end LED discharger 80 in the method of discharging the photoconductor 2 according to Embodiment 2.

The amount of light emitted (light emission amount) decreases in accordance with the time of light emitting. Accordingly, the supposed discharge completion point shifts to the downstream side in the direction of rotation of the photoconductor 2 as the end LED discharger 80 is used over time.

When the image forming apparatus 100 includes a counter to measure time equivalent to the light emission time of the end LED discharger 80 and has a capability to adjust the point at which end range discharge completes, deviations in the timing caused by the degradation with time of the end LED discharger 80 is inhibited.

Specifically, the controller 90 adjusts the supposed discharge completion point in the exposure range by the end LED discharger 80 to satisfy Formula 2 below.

$$L\min \leq V \cdot Tb \leq V \cdot Ta \leq L\max \qquad \text{Formula 2}$$

where Ta represents a period (in seconds) from when the end LED discharger 80 starts the exposure to when the LED head 70 starts the exposure for discharging, in a state in which the usage history of the end LED discharger 80 is relatively short; and Tb (in seconds) represents a period from when the end LED discharger 80 starts the exposure to when the LED head 70 starts the exposure for discharging, in a state in which the usage history of the end LED discharger 80 is relatively long.

This configuration is advantageous in suppressing the inconveniences such as adhesion of toner to the background area, falling of toner, and scattering of toner inside the apparatus, occurring relating to the degradation with time of the end LED discharger 80.

Next, descriptions are given below of a situation in which the image forming apparatus 100 has a low-speed mode used when sheet type is set to "thick sheet". In the low-speed mode, the speed of mechanical action is reduced, for example, by half from a normal speed.

It is assumed that, in a configuration in which the photoconductor 2 is driven at one of a plurality of rotation speeds (linear speeds), (i) the speed of mechanical action is at the low speed, and (ii) the light emission amount of the end LED discharger 80 is set to a normal amount.

In such a case, the point at which discharge of the photoconductor 2 is supposed to complete (in the exposure range by the end LED discharger 80) is shifted to the upstream side in the direction of rotation of the photoconductor 2.

To inhibit the deviation in the timing even in such a configuration, the image forming apparatus 100 is configured to adjust the point at which the end range discharge components, in accordance with the rotation speed of the photoconductor 2.

Specifically, in a configuration in which the photoconductor 2 is rotated at one of a plurality of speeds, the controller 90 adjusts the supposed discharge completion point in the exposure range by the end LED discharger 80 to satisfy Formula 3 below.

$$L\min \leq Vh \cdot Th \leq Vl \cdot Tl \leq L\max \qquad \text{Formula 3}$$

where Vh (in millimeters per second) represents the rotation speed of the photoconductor 2 in a high-speed mode, and Th (in seconds) represents a period from when the end LED discharger 80 starts the exposure to when the LED head 70 starts the exposure for discharging, in the high-speed mode. By contrast, Vl (in millimeters per second) represents the rotation speed of the photoconductor 2 in the low-speed mode, and Tl (in seconds) represents a period from when the end LED discharger 80 starts the exposure to when the LED head 70 starts the exposure for discharging, in the low-speed mode.

With this configuration, the following effects are attained.

In the image forming apparatus 100 having a plurality of operation modes in which the rotation speed (driving speed) of the photoconductor 2 are different, adhesion of toner to the background area, falling of toner, and scattering of toner inside the apparatus can be avoided in each of the plurality of operation modes.

The image forming apparatus according to the present embodiment can employ one of the methods of discharging the photoconductor 2 according to the above-described embodiments and variations, thereby attaining the effects similar to those attained by the above-described embodiment or the variation.

Although example configurations are described above with reference to the drawings, detailed structures and configurations according to aspects of this disclosure are not limited to the image forming apparatus 100 being a color printer employing a tandem system, but additional modifications and variations are possible in light of the above teachings.

For example, one or more of aspects of this disclosure are applicable to image forming apparatuses of other types, such as monochrome (or single-color) printers, copiers, facsimile machines, and multifunction peripherals having one of these capabilities.

The structures described above are examples, and the various aspects of the present specification attain respective effects as follows.

Aspect A

Aspect A concerns a method of discharging a latent image bearer used in an image forming apparatus that includes the latent image bearer, such as the photoconductor 2; a charger, such as charging roller 4, to charge a surface of the latent image bearer; an exposure device, such as the LED head 70, to expose an exposure range of the surface of the latent image bearer to form an electrostatic latent image on the latent image bearer; a developing device, such as the developing device 5, to supply developer to a developing range of the latent image bearer, thereby developing the electrostatic latent image; and a transfer device, such as the primary transfer roller 19, to transfer the developed toner onto a transfer medium, such as the intermediate transfer belt 16. The image forming apparatus further includes a discharger, such as the end LED discharger 80, different from the exposure device, to discharge the latent image bearer. After the transfer device transfers the toner image, the exposure device and the discharger discharge the surface of the latent image bearer when the rotation of the latent image bearer is stopped. The exposure device discharges the exposure range inside the developing range in the longitudinal direction of the latent image bearer, and the discharger discharges an area outside the exposure range and inside the developing range in the longitudinal direction of the latent image bearer.

According to this aspect, as described above, for example,

After the apparatus is left unused for a while, the surface potential of the latent image bearer is close to zero (0) volt at the activation of the developing device. Accordingly, in a case where the negatively (−) charged toner is used, at the activation, a positive (+) voltage is applied, as the developing bias, to the developer bearer of the developing device so that the negatively charged toner is not used in image development.

In a case where the latent image bearer has a negative (−) potential when the apparatus enters the standby or sleep mode or is shut down, the potential difference is large in the developing range if a positive (+) voltage is applied to the developer bearer at the subsequent activation of the apparatus. Then, unintended toner or undesirable toner adheres to the surface of the latent image bearer. Accordingly, the toner adheres to the background area, which is a portion to be free of toner. As a result, toner falling or toner scattering inside the apparatus may occur.

An approach to suppress such inconveniences is increasing the writing span by an exposure device incorporating a light-emitting element to a size greater than the maximum sheet size in the main scanning direction. However, it is difficult to reduce the space required for installation of the exposure device and make the exposure device compact in the main scanning direction.

Accordingly, reduction of size of the image forming apparatus may be difficult.

By contrast, in the discharging method according to Aspect A, the exposure device employing a light-emitting element and the discharger different from the exposure device are used. Accordingly, even when the exposure range of the exposure device is reduced to the maximum printing pattern width in the image forming apparatus, the developing range of the latent image bearer can be entirely discharged.

Therefore, even when the exposure span of the exposure device is reduce to the maximum printing width of the image forming apparatus, inconveniences such as adhesion of to the background area and falling of toner can be inhibited.

Additionally, even when the LED head 70 having an exposure range (printing pattern width) smaller than the developing range is used to discharge the latent image bearer, the latent image bearer can be discharged to the end of the developing range. Without extending the exposure device in the longitudinal direction, the conveniences such as adhesion of toner to the background area and toner falling can be inhibited.

Aspect B

In Aspect A, the discharger includes a light-emitting element such as an LED to expose the latent image bearer to discharge the latent image bearer.

As described in the embodiments above, this structure facilitates reduction of size of the discharger. Further, contactless discharging can suppress the wear of the latent image bearer with elapse of time.

Aspect C

In Aspect B, the amount of light emitted from the discharger to exposure the latent image bearer is different from the amount of light emitted from the exposure device to expose the latent image bearer.

As described above, since an aim of the discharging by the combination of the exposure device and the discharger is to discharge, entirely, the range outside the exposure range irradiated by the exposure device, the accuracy required for the exposure for discharging is not as strict as exposure for latent image writing.

According to Aspect C, setting the distance from the discharger to the latent image bearer can be made more flexible by making the amount of light to expose the latent image bearer different between the exposure device and the discharger. Then, the image forming apparatus can be compact.

Aspect D

In Aspect B or C, the resolution of exposure of the discharger is different from the resolution of exposure of the exposure device.

As described above, since an aim of the discharging by the combination of the exposure device and the discharger is to discharge, entirely, the range outside the exposure range irradiated by the exposure device, the accuracy required for the exposure for discharging is not as strict as exposure for latent image writing.

According to Aspect D, in addition to setting the distance from the discharger to the latent image bearer, setting the resolution of the discharger can be made more flexible by making the resolution in exposing the latent image bearer different between the discharger and the exposure device. Then, the size and cost of the image forming apparatus can be reduced.

Aspect E

In any one of Aspects A through D, the distance from the latent image bearer to the discharger is greater than the distance from the latent image bearer to the exposure device.

With this structure, the discharger can be disposed away from the periphery of the latent image bearer, where the structures relating to the developing system are disposed dense. The feature facilitates reduction in size of the image forming apparatus.

Aspect F

In any one of Aspects A through E, the span discharged by the discharger and the exposure device in combination is equal to or longer than the developing range on the latent image bearer in the main scanning direction of the latent image bearer (i.e., the longitudinal direction of the photoconductor 2.

According to this aspect, the entire developing range on the latent image bearer can be discharged.

Aspect G

In any one of Aspects A through F, the discharger includes a light-emitting element to expose the latent image bearer to discharge the latent image bearer, and a relation defined by Formula 1 is satisfied, $$Lmin \leq V \cdot T \leq Lmax \quad \text{Formula 1}$$

where Lmax represents the distance (in millimeters) between an upstream end of the discharge area by the discharger and the discharge area on the latent image bearer exposed by the exposure device (in the direction of rotation of the latent image bearer), Lmin represents the distance (in millimeters) between a downstream end of the discharge area by the discharger and the discharge area (exposed area) on the latent image bearer exposed by the exposure device (in the direction of rotation of rotation of the latent image bearer), V represents the rotation speed (in millimeters per second) of the latent image bearer, and T represents the duration (in seconds) from when the discharger starts discharging to when the exposure device starts discharging.

As described above, in the direction of rotation of the latent image bearer, the discharge start position by the exposure device and the discharge start position by the discharger may be different. In such an arrangement, depending on the discharge start timing of the exposure device and the discharge start timing of the discharger, variations are large regarding discharge start ranges in the main scanning direction of the latent image bearer.

If the variations are large, there is a risk that an undischarged portion of the surface of the latent image bearer, not discharged by either of the exposure device and the discharger, stops in the developing range, thereby partly degrading, in the main scanning direction of the latent image bearer, the effect of suppressing the inconveniences such as adhesion of toner to the background area and toner falling.

By contrast, when the distance Lmin, the distance Lmax, the rotation speed V, and the time T are set to satisfy the relation defined in Formula 1, the discharge start timing of the discharge start timings of the exposure device and the discharger at the end of operation can be adjusted to suppress the variations in the discharge start ranges in the main scanning direction of the latent image bearer.

Such suppression can inhibit the above-described inconvenience that an undischarged portion of the surface of the latent image bearer, not discharged by either of the exposure device and the discharger, stops in the developing range, thereby partly degrading, in the main scanning direction of the latent image bearer, the effect of suppressing adhesion of toner to the background area and toner falling.

Therefore, even when the exposure range of the exposure device is reduced to the maximum printing pattern width of the image forming apparatus, inconveniences such as adhesion of toner to the background area and falling of toner can be better inhibited.

Aspect H

In Aspect G, a relation defined by Formula 2 is satisfied.

$$Lmin \leq V \cdot Tb \leq V \cdot Ta \leq Lmax \quad \text{Formula 2}$$

where Ta represents a period (in seconds) from when the discharger starts the exposure to when the exposure device starts the exposure, in a state in which the usage history of the discharger is relatively short, and Tb represents a period (in seconds) from when the discharger starts the exposure to when the exposure device starts the exposure, in a state in which the usage history of the discharger is relatively long.

As described above, this aspect can inhibit, for example, background area, falling of toner, and scattering of toner inside the apparatus occurring as the discharger is used over time.

Aspect I

In Aspect G or H, the image forming apparatus has a plurality of rotation speeds (linear speeds) with which the latent image bearer is rotated, and Formula 3 is satisfied.

$$Lmin \leq Vh \cdot Th \leq Vl \cdot Tl \leq Lmax \quad \text{Formula 3}$$

where Vh represents the rotation speed of the latent image bearer in a high-speed mode, Th (in seconds) represents a period from when the discharger starts the exposure to when the exposure device starts the exposure, in the high-speed mode, Vl (in millimeters per second) represents the rotation speed of the latent image bearer in the low-speed mode, and Tl represents a period (in seconds) from when the discharger starts the exposure to when the exposure device starts the exposure, in a state in which the usage history of the discharger is relatively long.

According to this aspect, as described above, in the image forming apparatus having a plurality of operation modes in which the rotation speed (driving speed) of the latent image bearer are different, adhesion of toner to the background area, falling of toner, and scattering of toner inside the apparatus can be avoided in each of the plurality of operation modes.

Aspect J

In an image forming apparatus that includes a latent image bearer; a charger to charge a surface of the image bearer uniformly; an exposure device to expose the surface of the latent image bearer to form an electrostatic latent image on the latent image bearer; a developing device to supply developer to the electrostatic latent image on the latent image bearer, thereby developing the electrostatic latent image; and a discharger different from the exposure device, to discharge the latent image bearer, the method of discharging according to any one of Aspects A through I is used.

As described in the above-described embodiment, there is provided an image forming apparatus having advantages equivalent to the advantages of the transfer device according to any of Aspects A to I.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A discharging method used in an image forming apparatus including a latent image bearer, an exposure device to expose the latent image bearer to form an electrostatic latent image on the latent image bearer, and a discharger different from the exposure device, the discharging method comprising:

discharging, with the exposure device, an exposure range of the latent image bearer, the exposure range inside a developing range in a main scanning direction; and discharging, with the discharger, an area of the latent image bearer outside the exposure range and inside the developing range in the main scanning direction, wherein the discharging with the exposure device and the discharging with the discharger are performed when a rotation of the latent image bearer is stopped after a toner image is transferred from the latent image bearer.

2. The discharging method according to claim 1, wherein the discharging with the discharger includes emitting exposure light from a light-emitting element to the latent image bearer.

3. The discharging method according to claim 2, wherein an amount of light emitted from the discharger to exposure the latent image bearer is different from an amount of exposure light emitted from the exposure device to expose the latent image bearer.

4. The discharging method according to claim 2, wherein a resolution of exposure of the discharger is different from a resolution of exposure of the exposure device.

5. The discharging method according to claim 1, wherein a range discharged by the discharger and the exposure device in combination is equal to or longer than the developing range on the latent image bearer in the main scanning direction.

6. The discharging method according to claim 1, wherein the discharging with the discharger includes emitting exposure light from a light-emitting element to the latent image bearer, and the discharging method further comprises setting a relation defined by Formula 1, $$Lmin \leq V \cdot T \leq Lmax \quad \text{Formula 1}$$

where Lmax represents a distance in millimeters between an upstream end of a discharge area by the discharger and a discharge area by the exposure device in a direction of rotation of the latent image bearer;

Lmin represents a distance in millimeters between a downstream end of the discharge area by the discharger and the discharge area by the exposure device in the direction of rotation of the latent image bearer;

V represents the rotation speed in millimeters per second of the latent image bearer; and T represents a period in seconds from when the discharger starts the discharging to when the exposure device starts the discharging.

7. The discharging method according to claim 6, further comprising performing an adjustment to satisfy Formula 2, $$Lmin \leq V \cdot Tb \leq V \cdot Ta \leq Lmax \quad \text{Formula 2,}$$

where Ta represents a period in seconds from when the discharger starts the discharging to when the exposure device starts the discharging, in a state in which a usage history of the discharger is relatively short; and Tb represents a period in seconds from when the discharger starts the discharging to when the exposure device starts the discharging, in a state in which the usage history of the discharger is relatively long.

8. The discharging method according to claim 6, wherein the latent image bearer is rotated at one of a plurality of rotation speeds including a first speed and a second speed lower than the first speed, and wherein the discharging method further comprises performing an adjustment to satisfy Formula 3, $$Lmin \leq Vh \cdot Th \leq Vl \cdot Tl \leq Lmax \quad \text{Formula 3}$$

where Vh represents the first speed in millimeters per second;

Th represents a period in seconds from when the discharger starts the discharging to when the exposure device starts the discharging, while the latent image bearer is rotated at the first speed, Vl represents the second speed in millimeters per second; and Tl represents a period in seconds from when the discharger starts the discharging to when the exposure device starts the discharging, while the latent image bearer is rotated at the second speed.

9. An image forming apparatus comprising:

a latent image bearer to rotate;

a charger to charge the latent image bearer uniformly;

an exposure device to expose an exposure range of the latent image bearer to form an electrostatic latent image on the latent image bearer;

a developing device to develop, in a developing range, the electrostatic latent image with developer into a toner image, the developing range wider than the exposure range in a main scanning direction;

a transfer device to transfer the toner image from the image bearer onto a transfer medium; and a discharger different from the exposure device, to discharge the latent image bearer, wherein the exposure device and the discharger discharges the latent image bearer when rotation of the latent image bearer is stopped after the transfer device transfers the toner image, wherein the exposure device discharges the exposure range inside the developing range in the main scanning direction, and wherein the discharger discharges an area of the latent image bearer outside the exposure range and inside the developing range in the main scanning direction.

10. The image forming apparatus according to claim 9, wherein the discharger includes a light-emitting element to expose the latent image bearer to discharge the latent image bearer.

11. The image forming apparatus according to claim 9, wherein a distance from the latent image bearer to the discharger is greater from a distance from the latent image bearer to the exposure device.

* * * * *